US009430917B2

(12) United States Patent
Aponte et al.

(10) Patent No.: US 9,430,917 B2
(45) Date of Patent: Aug. 30, 2016

(54) DYNAMICALLY MAPPING WAGERING GAME CONTENT

(71) Applicant: Bally Gaming, Inc., Las Vegas, NV (US)

(72) Inventors: Peter J. Aponte, Las Vegas, NV (US); James J. Getz, Henderson, NV (US); Siva Kumar Krishnan, Bolingbrook, IL (US); Brian D. Manning, Las Vegas, NV (US); Krishnakumar Meluveettil, Chicago, IL (US)

(73) Assignee: BALLY GAMING, INC., Las Vegas, NV (US)

( * ) Notice: Subject to any disclaimer, the term of this patent is extended or adjusted under 35 U.S.C. 154(b) by 0 days.

(21) Appl. No.: 14/749,407

(22) Filed: Jun. 24, 2015

(65) Prior Publication Data

US 2015/0294538 A1 Oct. 15, 2015

Related U.S. Application Data

(63) Continuation of application No. 13/544,330, filed on Jul. 9, 2012, now Pat. No. 9,087,438.

(60) Provisional application No. 61/505,658, filed on Jul. 8, 2011.

(51) Int. Cl.
*G07F 17/34* (2006.01)
*G07F 17/32* (2006.01)

(52) U.S. Cl.
CPC ..... *G07F 17/34* (2013.01); *G07F 17/3204* (2013.01); *G07F 17/3211* (2013.01)

(58) Field of Classification Search
USPC ..... 463/20, 21, 25
See application file for complete search history.

(56) References Cited

U.S. PATENT DOCUMENTS

2006/0019743 A1 1/2006 Roemer
2006/0218029 A1 9/2006 Chin (Continued)

FOREIGN PATENT DOCUMENTS

EP 0727245 5/2000
WO 0172387 10/2001

(Continued)

OTHER PUBLICATIONS

"PCT Application No. PCT/US08/81643 International Preliminary Report on Patentability", Aug. 5, 2010, 16 pages.

(Continued)

*Primary Examiner* — Pierre E Elisca
(74) *Attorney, Agent, or Firm* — DeLizio Law, PLLC

(57) ABSTRACT

A wagering game system ("system") and its operations are described herein. In some examples, the operations include electronically determining, via an electronic communication interface of the system, display coordinates associated with first content of a first wagering game application ("first application") for presentation on an electronic display device associated with the system. The first application is independent from a second wagering game application ("second application"). The operations can further include automatically mapping, via an electronic processing unit of the system, second content for the second application to the display coordinates. The operations can further include, based on the mapping, electronically presenting, via the electronic display device, the second content affixed relative to the first content during concurrent game play of the first application and the second application. The first content indicates a first game outcome independent from a second game outcome indicated by the second content.

23 Claims, 12 Drawing Sheets

(56) References Cited

U.S. PATENT DOCUMENTS

| | | | | |
|---|---|---|---|---|
| 2007/0004519 | A1 | 1/2007 | Swart et al. | |
| 2007/0155465 | A1* | 7/2007 | Walker | G07F 17/32 463/16 |
| 2007/0243925 | A1 | 10/2007 | LeMay et al. | |
| 2010/0240455 | A1 | 9/2010 | Gagner et al. | |
| 2010/0304855 | A1 | 12/2010 | Acres | |
| 2013/0178271 | A1* | 7/2013 | Aponte | G07F 17/34 463/20 |
| 2013/0244761 | A1* | 9/2013 | Agarwal | G07F 17/3211 463/25 |
| 2014/0106865 | A1* | 4/2014 | Adiraju | G07F 17/3211 463/25 |
| 2014/0315619 | A1* | 10/2014 | Bowers | G07F 17/3213 463/20 |

FOREIGN PATENT DOCUMENTS

| | | |
|---|---|---|
| WO | 2006093146 | 9/2006 |
| WO | WO2007117418 | 10/2007 |
| WO | WO2009061651 | 5/2009 |
| WO | 2009108400 | 9/2009 |
| WO | 2010132206 | 11/2010 |

OTHER PUBLICATIONS

"PCT Application No. PCT/US08/81643 International Search Report", Jan. 21, 2009, 9 pages.
"U.S. Appl. No. 12/741,643 Final Office Action", Sep. 12, 2011, 30 Pages.
"U.S. Appl. No. 12/741,643 Office Action", Oct. 29, 2010, 15 Pages.
"U.S. Appl. No. 12/741,643 Office Action", Mar. 19, 2015, 20 Pages.
"U.S. Appl. No. 12/741,643 Office Action", Mar. 3, 2011, 19 pages.
"U.S. Appl. No. 13/544,330 Office Action", Jan. 31, 2014, 6 Pages.
"U.S. Appl. No. 13/544,330 Office Action", Sep. 19, 2014, 6 Pages.
Co-pending U.S. Appl. No. 13/544,330, filed Jul. 9, 2012, 59 pages.
"U.S. Appl. No. 12/741,643 Final Office Action", Aug. 20, 2015, 13 Pages.

* cited by examiner

DYNAMICALLY MAPPING WAGERING GAME CONTENT

RELATED APPLICATIONS

This application is a continuation application of, and claims priority benefit of, U.S. application Ser. No. 13/544,330 filed Jul. 9, 2012, which claims the priority benefit of U.S. Provisional Application No. 61/505,658 filed Jul. 8, 2011. The Ser. No. 13/544,330 application is incorporated by reference herein in its entirety. The 61/505,658 Application is incorporated by reference herein in its entirety.

LIMITED COPYRIGHT WAIVER

A portion of the disclosure of this patent document contains material that is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2015, WMS Gaming, Inc.

TECHNICAL FIELD

Embodiments of the inventive subject matter relate generally to wagering game systems and networks that, more particularly, present multiple wagering games.

BACKGROUND

Wagering game machines, such as slot machines, video Poker machines and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for wagering game machine manufacturers to continuously develop new games and gaming enhancements that will attract frequent play. For example, some wagering game providers have developed electronic gaming machines (EGMs) that can present more than one game or feature, such as a bonus game or an additional wagering game that can run on the same EGM configured to present a primary, or "base" wagering game. Wagering game providers, therefore, are continuously interested in developing new ways of presenting and controlling multiple games and features via the same device.

BRIEF DESCRIPTION OF THE DRAWING(S)

Embodiments are illustrated in the Figures of the accompanying drawings in which.

DESCRIPTION OF ILLUSTRATIVE EMBODIMENTS

This description of the embodiments is divided into six sections. The first section provides an introduction to embodiments. The second section describes example operating environments while the third section describes example operations performed by some embodiments. The fourth section describes additional example embodiments while the fifth section describes additional example operating environments. The sixth section presents some general comments.

Introduction

This section provides an introduction to some embodiments.

As mentioned previously, an EGM, or wagering game machine, can run multiple games, features, etc. The base game may be referred to as the "primary" content for the wagering game machine. Any other content that is presented via the wagering game machine may be referred to as "secondary" content, such as secondary wagering games. Presenting multiple games and features on the same wagering game machine can be appealing to a wagering game player ("player") because the player can access different types of content at the same wagering game machine. However, secondary content can also distract a player from playing the primary wagering game, thus affecting an amount of money that the player spends on the primary wagering game during a wagering game session.

Embodiments of the inventive subject matter, however, present an innovative way of integrating presentation and function of secondary content with primary wagering game content on a wagering game machine to keep a player's attention focused on the primary wagering game. For example, some embodiments overlay a portion of secondary wagering game content over primary wagering game content while each game plays at approximately the same time. In some embodiments random game outcomes for each of the secondary wagering game and the primary wagering game remain separate, and independent, yet concurrent presentation of the primary and secondary wagering games are integrated in a way that incorporates characteristics (e.g., appearance, location, movement, etc.) of overlaid secondary wagering game content with characteristics (e.g., appearance, location, movement, etc.) of the primary wagering game content. The game outcomes for each game can also be revealed concurrently, in the superimposed configuration. Thus, in some examples, the overlaying of the portion of the secondary wagering game content over the primary wagering game content can keep a player's attention focuses on the area of a display dedicated to the presentation of the primary wagering game content. Further, in some examples, the concurrent play and reveal of outcomes for both games, in a superimposed configuration, can keep a player's attention focused on wagering for both a primary wagering game and a secondary wagering game.

Figure 1A:
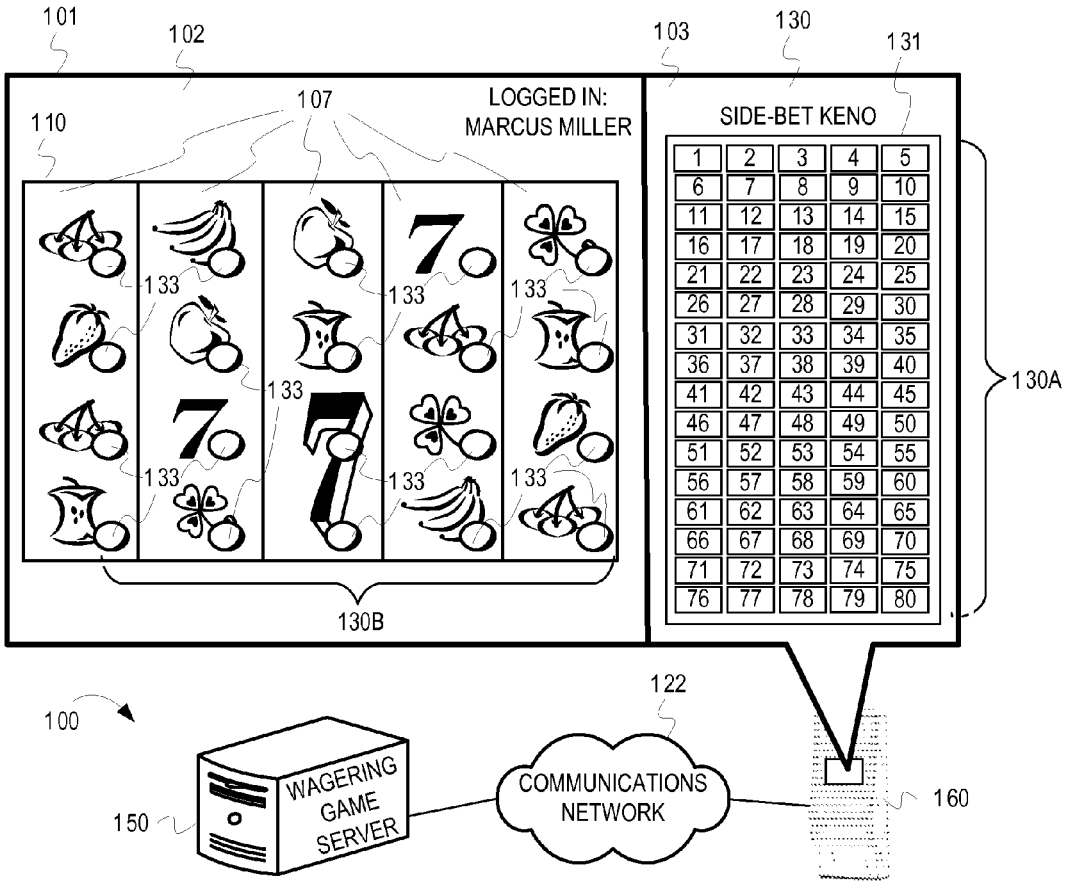
FIGS. 1A-1B are illustrations of dynamically overlaying and controlling a secondary wagering application concurrently with a primary wagering game application, according to some embodiments.
Figure 1B:
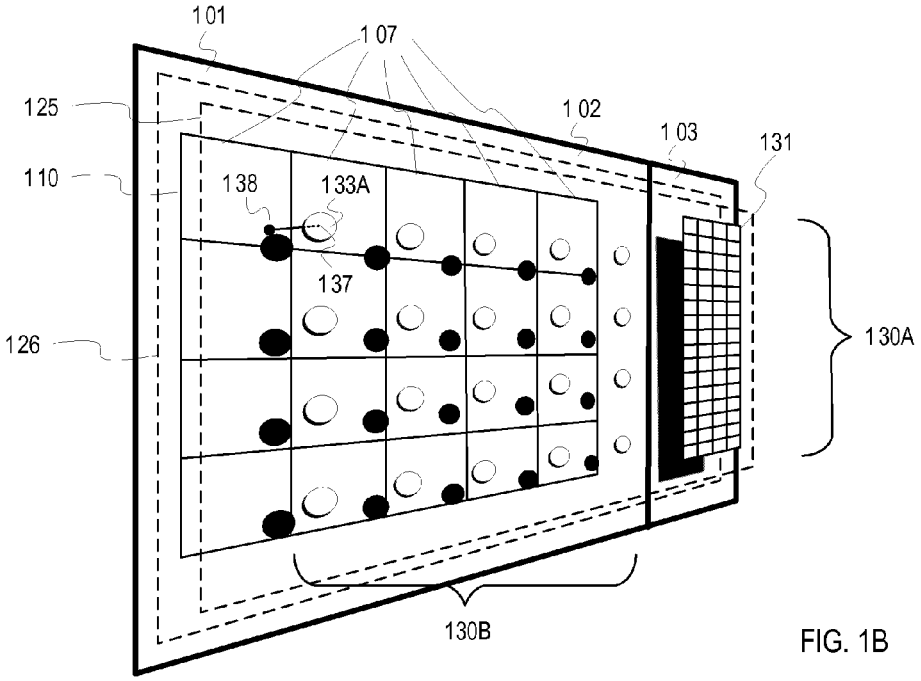

FIGS. 1A-1B are illustrations of dynamically overlaying and controlling a secondary wagering application concurrently with a primary wagering game application, according to some embodiments. In FIG. 1A, a wagering game system ("system") 100 includes a wagering game machine 160 connected to a wagering game server 150 via a communications network 122. The system 100 can store and present primary wagering game content ("primary content") 110 in a first area 102 of a display 101, which presents a graphical user interface for the primary content 110. The primary content 110 can be presented for a primary wagering game application controlled via the wagering game machine 160, the wagering game server 150, or a combination of both. The system 100 can also store and present secondary content 130, such as for a secondary wagering game application (e.g., a Keno game), in a second area 103 of the display 101. The second area 103 may be referred to as a secondary container, a toolbar, a side-window or side-bar, etc., which indicates its position of a secondary, or ancillary nature to that of the first area 103. The secondary content 130 is secondary, or ancillary, in purpose, nature, priority, position, etc. to the primary content 110. For example, the wagering game machine 160 can be configured to present the primary content 110 for a base game, or game that is primarily available and presentable during a wagering game session for the wagering game machine 160. The secondary content 130, however, can be temporary, or swappable, and therefore, may be considered as secondary, or ancillary, in purpose, nature, priority, position, etc., to that of the primary content 110. Thus, the first area 102 is primary dedicated to the presentation of the primary content 110 and the second area 103 to the presentation of the secondary content 130. In some embodiments, the primary content 110 is contained exclusively in the first area 102. The wagering game machine 160 can present the primary content 110 and the secondary content 130 via the display 101, via speakers, via emotive lighting, via peripheral devices, etc. In some embodiments, the wagering game server 150 can provide the primary content 110 (e.g., as server-based games), the secondary content 130 (e.g., server-side game applications), non-gaming content, or other content, information, services, control data, etc. to the wagering game machine 160. The system 100 can further include an account server (e.g., see account server 270 of FIG. 2) that hosts a player account (e.g., an account that the user "Marcus Miller" uses to track wagering account information, player profile data, player history, etc.), and which becomes associated with the wagering game machine 160 during a wagering game session when a player (e.g., Marcus Miller) logs in to the wagering game machine 160.

Figure 10:
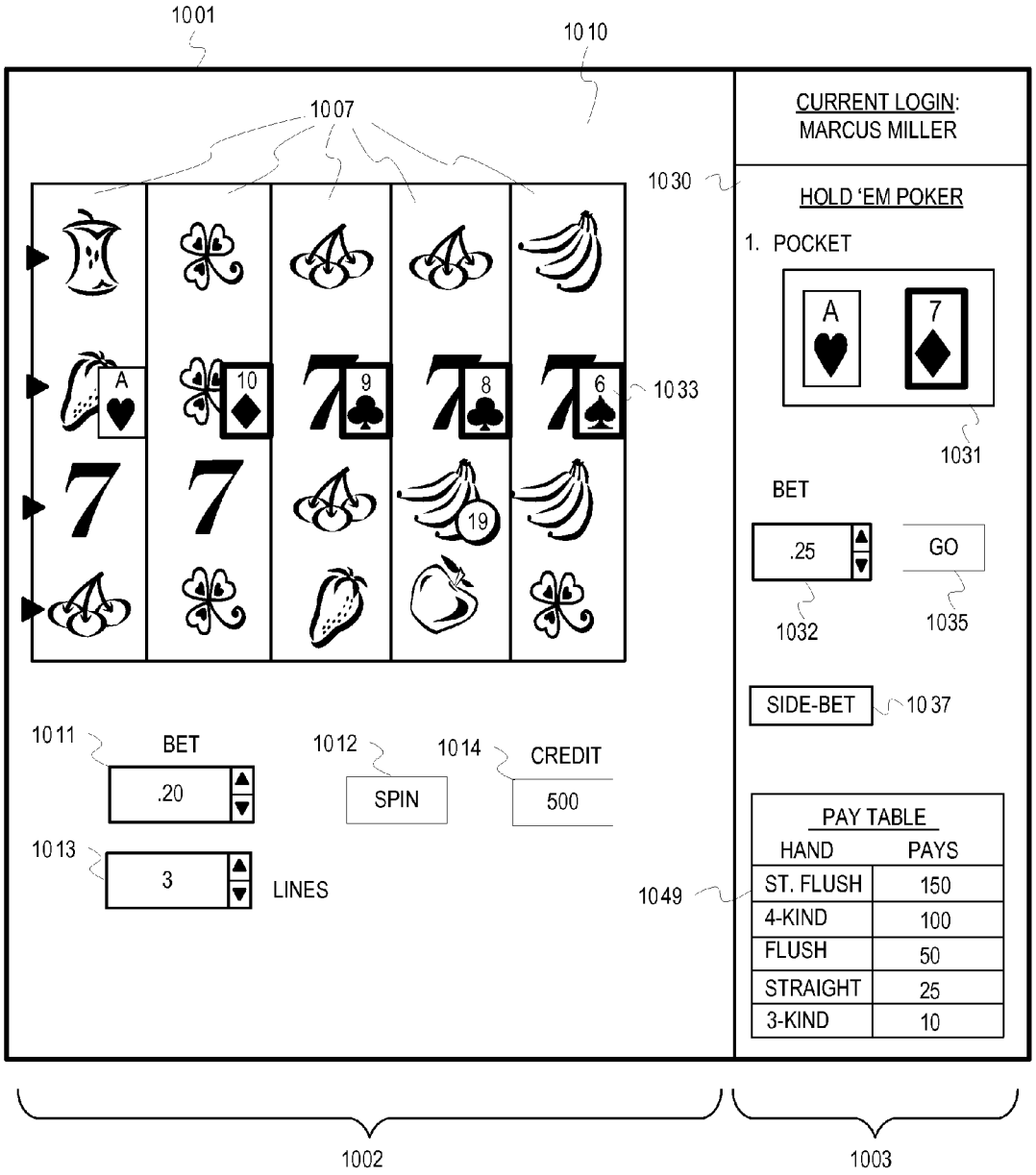
FIG. 10 is an illustration of dynamically overlaying presentation and controlling a Poker type, secondary wagering game application with a slot-style, primary wagering game application, according to some embodiments.

Still referring to FIG. 1A, the system 100 presents a first portion 130A of the secondary content 130 in the second area 103 while, concurrently, presenting a second portion 130B of the secondary content 130 in the first area 102. One example used in this description includes a type of Keno secondary game with graphical representations of Keno balls (e.g., objects 133) superimposed over slot reels ("reels") 107 of the primary content 110, however other examples might include other types of games, such as a Poker secondary game (e.g., as shown in FIG. 10), a Black Jack secondary game, etc. For example, the system 100 presents the objects 133, which represent Keno balls for the secondary content 130, over the reels 107. The objects 133 represent the second portion 130B of the secondary content 130. The system 100 uses the objects 133 to present an outcome associated with the secondary content 130 (e.g., to present an outcome for the Keno game). The outcome for the secondary content 130 can be independent and separate from an outcome for the primary content 110 (i.e., separate from an outcome for the slot game). For example, the system 100 randomly selects a number of values indicated within an organized grouping, such as a table, a matrix, or a grid 131 for the secondary content 130. The number of values that the system 100 will randomly select from the grid 131 can coincide with a number of the objects 133 so that the system 100 can reveal each one of the randomly selected values in individuals ones of the objects. For instance, the system 100 presents twenty of the objects 133 because the system 100 is configured to randomly select twenty values from the grid 131 (e.g., to randomly draw twenty Keno balls). Other embodiments, however, may present fewer of the objects 133 (e.g., present only one large object that reveals all twenty of the randomly selected values). The amount of values in the grid 131 is more than the number of the objects 133 (e.g., the grid 131 contains eighty values). The system 100 can detect, via user input, that a user selects one or more of the values within the grid 131 (e.g., the user picks ten of the numbers from the grid 131 according to the Keno game rules). After a player has selected one or more of the numbers within the grid 131 (e.g., the player selects the ten of the numbers in the grid 131 for the Keno game), and after a player places a wager on the secondary wagering game and/or selects a control to activate the secondary wagering game, the system 100 randomly selects a subset of the numbers in the grid 131 (e.g., the system 100 draws twenty Keno balls by randomly selecting the twenty of the values in the grid 131 according to the rules of the Keno game). The system 100 presents the randomly selected subset of the numbers in the grid 131 on the objects 133 (e.g., the system presents the values for the twenty randomly drawn Keno balls). The system 100 also detects whether the one or more of the numbers selected by the player are included in the subset of the numbers in the grid 131 (e.g., detects whether any of the ten numbers selected by the player equate to any of the twenty numbers drawn for the Keno game). If enough of the player-selected numbers match up to the randomly-selected subset of the numbers (e.g., if more than a four of the player's selected numbers equate to the twenty numbers drawn for the Keno game), then the system 100 can highlight the matching number presented via the objects 133 and provide a reward based on a how many of the player-selected numbers matched. In some embodiments, the system 100 can also present play of the secondary content 130 concurrently with play of the primary content 110 (e.g., the system 100 causes the objects 133 to move in unison with the reels 107 as the reels spin), however the mathematical outcomes of both the primary game (e.g., the slot game) and the secondary game (e.g., the Keno game) can remain separate, and independent.

FIG. 1B illustrates an example of presenting the second portion 130B (e.g., the objects 133) of the secondary content 130 via the first area 102 of the display 101. In FIG. 1B, the system 100 presents a transparent layer 125 (e.g., a transparent window, transparent presentation layer, a transparent display, etc.) over a non-transparent layer 126. The transparent layer 125 is assigned to the exclusive presentation of the secondary content 130. The system 100 presents the first portion 130A of the secondary content 130 over the portion of the display 101 that corresponds to the second area 103 and presents the second portion 130B over the portion of the display 101 that corresponds to the first area 102. The system 100 can also map and affix the objects 133 within the transparent layer 125 so that they remain locked into position relative to the reels 107. Thus, when the reels 107 move, the objects 133 move in unison. For example, the system 100 maps a first point coordinate 137 on the transparent layer 125 to a point coordinate 138 on the non-transparent layer 116. The first point coordinate 137 is associated with one of the objects 133 (e.g., specifically object 133A). Each of the objects 133 can have similar point coordinates on the transparent layer 125 mapped to corresponding point coordinates on the non-transparent layer 126. Thus, the system 100 can cause all of the objects 133 to move in concert with individual or collective movement of the reels 107.

Thus, in some embodiments, because of the presentation of the second portion 130B of the secondary content 130 in the first area 102, the system 100 can focus a player's attention of wagering game play on the first area 102 during play of both the secondary wagering game and the primary wagering game. By maintaining a user's focus on the first area 102, and by providing concurrent play features of the primary wagering game and the secondary wagering game, the system 100 can, in some embodiments, maximize game play of both the primary wagering game and the secondary wagering game. Further, in some embodiments, the overlapped content expands the presentation domain of the secondary wagering game application and also provides interesting integrated behaviors of the primary content 110 and the secondary content 130, which can further captivate a player's interest and motivate continual game play.

Although FIGS. 1A and 1B describe some embodiments, the following sections describe many other features and embodiments.

Further, some embodiments of the inventive subject matter describe examples of overlaying and controlling wagering game content in a network wagering venue (e.g., an online casino, a wagering game website, a wagering network, etc.) using a communication network, such as the communications network 112 in FIG. 1. Embodiments can be presented over any type of communications network that provides access to wagering games, such as a public network (e.g., a public wide-area-network, such as the Internet), a private network (e.g., a private local-area-network gaming network), a file sharing network, a social network, etc., or any combination of networks. Multiple users can be connected to the networks via computing devices. The multiple users can have accounts that subscribe to specific services, such as account-based wagering systems (e.g., account-based wagering game websites, account-based casino networks, etc.).

Further, in some embodiments herein a user may be referred to as a player (i.e., of wagering games), and a player may be referred to interchangeably as a player account. Account-based wagering systems utilize player accounts when transacting and performing activities, at the computer level, that are initiated by players. Therefore, a "player account" represents the player at a computerized level. The player account can perform actions via computerized instructions. For example, in some embodiments, a player account may be referred to as performing an action, controlling an item, communicating information, etc. Although a player, or person, may be activating a game control or device to perform the action, control the item, communicate the information, etc., the player account, at the computer level, can be associated with the player, and therefore any actions associated with the player can also be associated with the player account. Therefore, for brevity, to avoid having to describe the interconnection between player and player account in every instance, a "player account" may be referred to herein in either context. Further, in some embodiments herein, the word "gaming" is used interchangeably with "gambling."

Example Operating Environments

This section describes example operating environments and networks and presents structural aspects of some embodiments. More specifically, this section includes discussion about wagering game system architectures.

Wagering Game System Architecture

Figure 2:
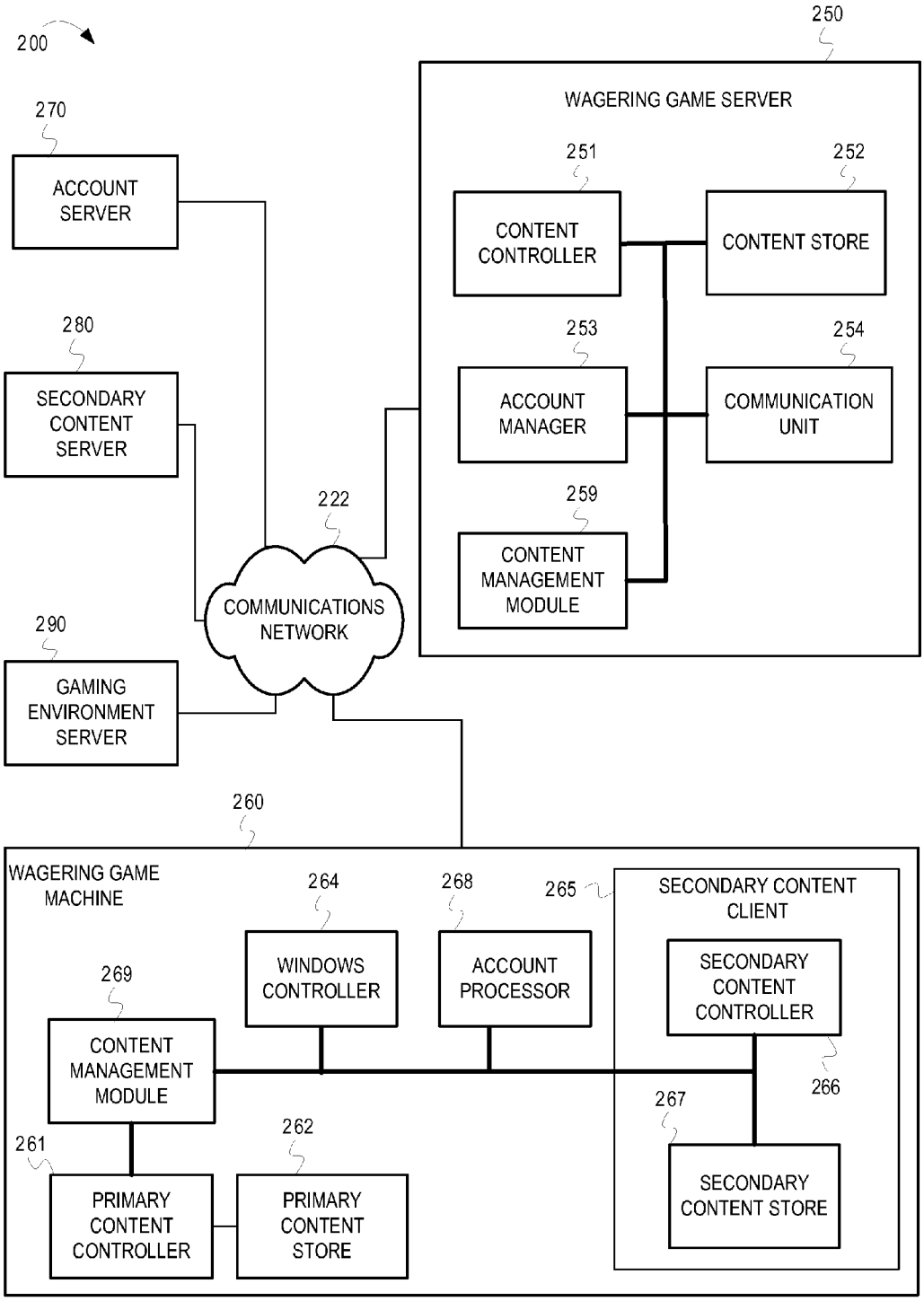
FIG. 2 is an illustration of a wagering game system architecture 200, according to some embodiments.

FIG. 2 is a conceptual diagram that illustrates an example of a wagering game system architecture 200, according to some embodiments. The wagering game system architecture 200 can include an account server 270 configured to control user related accounts accessible via wagering game networks and social networking networks. The account server 270 can store wagering game player account information, such as account settings (e.g., settings related to group games, settings related to social contacts, etc.), preferences (e.g., player preferences regarding audio, player preferences regarding text, player preferences regarding game themes, player preferences regarding award types, preferences related to virtual assets, etc.), player profile data (e.g., name, avatar, screen name, etc.), and other information for a player's account (e.g., financial information, account identification numbers, virtual assets, social contact information, etc.). The account server 270 can contain lists of social contacts referenced by a player account. The account server 270 can also provide auditing capabilities, according to regulatory rules. The account server 270 can also track performance of players, machines, and servers.

The wagering game system architecture 200 can also include a wagering game server 250 configured to control wagering game content, provide random numbers, and communicate wagering game information, account information, and other information to and from a wagering game machine 260. The wagering game server 250 can include a content controller 251 configured to manage and control content for the presentation of content on the wagering game machine 260. For example, the content controller 251 can generate game results (e.g., win/loss values), including win amounts, for games played on the wagering game machine 260. The content controller 251 can communicate the game results to the wagering game machine 260. The content controller 251 can also generate random numbers and provide them to the wagering game machine 260 so that the wagering game machine 260 can generate game results. The wagering game server 250 can also include a content store 252 configured to contain content to present on the wagering game machine 260. The wagering game server 250 can also include an account manager 253 configured to control information related to player accounts. For example, the account manager 253 can communicate wager amounts, game results amounts (e.g., win amounts), bonus game amounts, etc., to the account server 270. The wagering game server 250 can also include a communication unit 254 configured to communicate information to the wagering game machine 260 and to communicate with other systems, devices and networks. The wagering game server 250 can also include a content management module 259 configured, in some embodiments, to dynamically overlay and control secondary wagering applications concurrently with primary wagering game applications.

The wagering game system architecture 200 can also include a secondary content server 280 configured to provide content and control information for secondary games and other secondary content available on a wagering game network (e.g., secondary wagering game content, promotions content, advertising content, player tracking content, web content, etc.). The secondary content server 280 can provide "secondary" content, or content for "secondary" games presented on the wagering game machine 260. "Secondary" in some embodiments can refer to an application's importance or priority of the data. In some embodiments, "secondary" can refer to a distinction, or separation, from a primary application (e.g., separate application files, separate content, separate states, separate functions, separate processes, separate programming sources, separate processor threads, separate data, separate control, separate domains, etc.). Nevertheless, in some embodiments, secondary content and control can be passed between applications (e.g., via application protocol interfaces), thus becoming, or falling under the control of, primary content or primary applications, and vice versa. In some embodiments, the secondary content can be in one or more different formats, such as Adobe® Flash®, Microsoft® Silverlight™, Adobe® Air™, hyper-text markup language, etc. In some embodiments, the secondary content server 280 can provide and control content for community games, including networked games, social games, competitive games, or any other game that multiple players can participate in at the same time. In some embodiments, the secondary content server 280 can control and present an online website that hosts wagering games. The secondary content server 280 can also be configured to present multiple wagering game applications on the wagering game machine 260 via a wagering game website, or other gaming-type venue accessible via the Internet. The secondary content server 280 can host an online wagering website and/or a social networking website. The secondary content server 280 can include other devices, servers, mechanisms, etc., that provide functionality (e.g., controls, web pages, applications, etc.) that web users can use to connect to a social networking application and/or website and utilize social networking and website features (e.g., communications mechanisms, applications, etc.). The secondary content server 280 can also be configured to, in some embodiments, dynamically overlay and control secondary wagering applications concurrently with primary wagering game applications. In some embodiments, the secondary content server 280 can also host social networking accounts, provide social networking content, control social networking communications, store associated social contacts, etc. The secondary content server 280 can also provide chat functionality for a social networking website, a chat application, or any other social networking communications mechanism. In some embodiments, the secondary content server 280 can utilize player data to determine marketing promotions that may be of interest to a player account. The secondary content server 280 can also analyze player data and generate analytics for players, group players into demographics, integrate with third party marketing services and devices, etc. The secondary content server 280 can also provide player data to third parties that can use the player data for marketing. In some embodiments, the secondary content server 280 can provide one or more social networking communication mechanisms that publish (e.g., post, broadcast, etc.) a message to a mass (e.g., to multiple people, users, social contacts, accounts, etc.). The social networking communication mechanism can publish the message to the mass simultaneously. Examples of the published message may include, but not be limited to, a blog post, a mass message post, a news feed post, a profile status update, a mass chat feed, a mass text message broadcast, a video blog, a forum post, etc. Multiple users and/or accounts can access the published message and/or receive automated notifications of the published message.

The wagering game system architecture 200 can also include a gaming environment server 290 configured to present environmental light and sound effects in a casino environment. The gaming environment server 290 is further configured to provide content data, user data, and control information regarding gaming effects within a casino environment. For example, the gaming environment server 290 can coordinate a synchronized presentation of lighting and sound effects across a bank of wagering game machines and/or other lighting and sound producing devices within one or more areas of a casino. The gaming environment server 290 can also be configured to detect gaming events, such as events generated by the wagering game server 250 and/or the wagering game machine 260. The gaming environment server 290 can generate data for a synchronized light/sound show based on the gaming events. The gaming environment server 290 can control environmental light presentation devices within a casino. The gaming environment server 290 can provide emotive lighting presentation data, including light presentation commands on emotive lighting devices on or near wagering game machines, as well as other devices within the casino such as spotlights, overhead emotive lighting, projectors, etc. The gaming environment server 290 can be configured to determine multimedia, casino-content, including casino-wide special effects that include sound effects and light effects. The multi-media casino content can be presentable across a plurality of casino content presentation devices ("presentation devices") in a casino. The multi-media, casino-content effect can be related to a wagering game presentation or event. The wagering game presentation or event can be tied to the functionality, activity, or purpose of a wagering game. For instance, wagering game presentations can be related to attracting wagering game players to groups of wagering game machines, presenting game related outcomes across multiple wagering game machines, expressing group gaming activity across multiple wagering game machines, focusing attention on a particular person or machine in response to a gaming event, etc. The presentation devices present sound and light effects that accompany a gaming event (e.g., a jackpot celebratory effect that focuses on a wagering game machine, a lightning strike that introduces a community gaming event, and a musical chair game that reveals a community wagering game winner). The gaming environment server 290 can also be configured to determine timing control data for the multi-media effect. In some embodiments, timing control data can be stored on the gaming environment server 290, or be accessible to the gaming environment server 290 via another device (e.g., a lighting controller associated with a bank of wagering game machines), to use to send lighting commands in sequential order to network addresses of presentation device on a casino network. The gaming environment server 290 can determine channels assigned with casino-content presentation devices, such as the wagering game machine 260. In some embodiments, the presentation devices can have an addresses assigned to a channel. For example, the wagering game machine 260 could be on one channel, peripheral devices could be on another channel, network light presentation devices can be on other channels, etc. In some embodiments, the gaming environment server 290 can be a DMX controller connected in parallel to an emotive lighting controller on, or associated with, the wagering game machine 260. The DMX controller can also be connected in parallel to a plurality of other presentation devices (e.g., other wagering game machines, lighting presentation devices, etc.) within a casino, and can simultaneously provide DMX lighting commands to the wagering game machine 260 and to the other presentation devices. DMX can change light intensity, or other light characteristics, over time. Some embodiments of DMX controllers can update commands very quickly (e.g., 30-47 times a second) across multiple channels (e.g., 512 channels). A DMX controller can put different commands in every channel (e.g., one channel can have show "X," one channel can have show "Y," etc.). The DMX can also have a frame number within a show. Some devices can take up more than one channel (e.g., an emotive light might have three colors and may take up a channel for each color, a spotlight might have seven channels, etc.). Each device can receive 512 bytes of data from the DMX controller at any given time interval (e.g., frame). The 512 bytes of data can be divided in different ways. For example, 6 bytes may address light effect behavior, 6 bytes may include show numbers, 6 bytes may include frame numbers, 1 byte may include priority values, and so on for various light effect characteristics (e.g., intensity, color, pan, tilt, etc.). The presentation device that receives the DMX command data is programmed to interpret the lighting data in the channel. In some embodiments, the presentation devices can be DMX compliant including having a DMX input port to accept DMX commands. In some embodiments, presentation devices can convert the DMX commands to proprietary commands. In addition to the DMX protocol, other types of dedicated lighting protocols can include AMX 192, CMX, SMX, PMX, protocols included in the EIA-485 standard, etc. In some embodiments, the gaming environment server 290 can integrate with the content management module 259 to generate anticipatory and celebratory effects for events related to overlaid content, such as for portions of secondary game content that is overlaid onto a primary wagering game, or that spans multiple machines. For example, the content management module 259, in cooperation with the secondary content server 280 may overlay objects for a group, or community, game onto primary gaming content at multiple wagering game machines in a bank, or across a casino. The gaming environment server 290 can detect winning events, for example, on one or more of the wagering game machines, and present lighting and sound effects that highlight the wagering game machines that experience the winning events.

The wagering game system architecture 200 can also include the wagering game machine 260 configured to present wagering games and receive and transmit information to manage multiple wagering game applications. The wagering game machine 260 can include a primary content controller 261 configured to manage and control the presentation of primary content on the wagering game machine 260. The wagering game machine 260 can also include a primary content store 262 configured to contain primary content to present on the wagering game machine 260. The wagering game machine 260 can also include a content management module 269 configured, in some embodiments, to dynamically overlay and control secondary content, such as for secondary wagering games, concurrently with primary wagering game applications. The content management module 269 can further manage multiple instances of gaming applications. For example, the content management module 269 can be configured to launch, load, unload and control applications and instances of applications. The content management module 269 can launch different software players (e.g., a Microsoft® Silverlight™ player, an Adobe® Flash® player, etc.) and manage, coordinate, and prioritize what the software players do. The content management module 269 can also coordinate instances of server applications in addition to local copies of applications. The content management module 269 can control window locations on a wagering game screen or display for the multiple gaming applications. In some embodiments, the content management module 269 can manage window locations on multiple displays including displays on devices associated with and/or external to the wagering game machine 260 (e.g., a top display and a bottom display on the wagering game machine 260, a peripheral device connected to the wagering game machine 260, a mobile device connected to the wagering game machine 260, etc.). The content management module 269 can manage priority or precedence of client applications that compete for the same display area. For instance, the content management module 269 can determine each client application's precedence. The precedence may be static (i.e. set only when the client application first launches or connects) or dynamic. The applications may provide precedence values to the content management module 269, which the content management module 269 can use to establish order and priority. The precedence, or priority, values can be related to tilt events, administrative events, primary game events (e.g., hierarchical, levels, etc.), secondary game events, local bonus game events, advertising events, etc. As each client application runs, it can also inform the content management module 269 of its current presentation state. The applications may provide presentation state values to the content management module 269, which the content management module 269 can use to evaluate and assess priority. Examples of presentation states may include celebration states (e.g., indicates that client application is currently running a win celebration), playing states (e.g., indicates that the client application is currently playing), game starting states (e.g., indicates that the client application is showing an invitation or indication that a game is about to start), status update states (e.g., indicates that the client application is not 'playing' but has a change of status that should be annunciated, such as a change in progressive meter values or a change in a bonus game multiplier), idle states (e.g., indicates that the client application is idle), etc. In some embodiments, the content management module 269 can be pre-configurable. The system can provide controls and interfaces for operators to control screen layouts and other presentation features for the configuring the content management module 269. The content management module 269 can communicate with, and/or be a communication mechanism for, a base game stored on a wagering game machine. For example, the content management module 269 can communicate events from the base game such as the base game state, pay line status, bet amount status, etc. The content management module 269 can also provide events that assist and/or restrict the base game, such as providing bet amounts from secondary gaming applications, inhibiting play based on gaming event priority, etc. The content management module 269 can also communicate some (or all) financial information between the base game and other applications including amounts wagered, amounts won, base game outcomes, etc. The content management module 269 can also communicate pay table information such as possible outcomes, bonus frequency, etc.

In some embodiments, the content management module 269 can control different types of applications. For example, the content management module 269 can perform rendering operations for presenting applications of varying platforms, formats, environments, programming languages, etc. For example, the content management module 269 can be written in one programming language format (e.g., JavaScript, Java, C++, etc.) but can manage, and communicate data from applications that are written in other programming languages or that communicate in different data formats (e.g., Adobe® Flash®, Microsoft® Silverlight™, Adobe® Air™, hyper-text markup language, etc.). The content management module 269 can include a portable virtual machine capable of generating and executing code for the varying platforms, formats, environments, programming languages, etc. The content management module 269 can enable many-to-many messaging distribution and can enable the multiple applications to communicate with each other in a cross-manufacturer environment at the client application level. For example, multiple gaming applications on a wagering game machine may need to coordinate many different types of gaming and casino services events (e.g., financial or account access to run spins on the base game and/or run side bets, transacting drink orders, tracking player history and player loyalty points, etc.).

The wagering game machine 260 can also include a windows controller 264 configured to work in conjunction with the content management module 269 to perform instructions received by, and or generate instructions on behalf of, the content management module 269, that manipulate and control windows, or other user interfaces, presented on the wagering game machine 260. The wagering game machine 260 can also include an account processor 268 configured to control and communicate account information (e.g., financial transactions, player tracking information, etc.). The wagering game machine 260 can also include at least one secondary content client 265 configured to present secondary content applications (e.g., client player instances). The secondary content client 265 can receive event data from, and provide event data to, the content management module 269. The secondary content client 265 can include a secondary content controller 266 and a secondary content store 267. The secondary content controller 266 can be configured to manage and control the presentation of secondary content on the wagering game machine 260, which secondary content is specific to the secondary content client 265. The secondary content store 267 can be configured to store secondary content on the wagering game machine 260. In some examples, the content management module 269 can stack presentation layers related to the secondary content client 265, and other secondary content clients, over each other and over primary content using degrees of transparency to give the appearance of superimposition of the content.

Each component shown in the wagering game system architecture 200 is shown as a separate and distinct element connected via a communications network 222. However, some functions performed by one component could be performed by other components. For example, the wagering game server 250 can also be configured to perform functions of the secondary content server 280, the gaming environment server 290, and other network elements and/or system devices. Furthermore, the components shown may all be contained in one device, but some, or all, may be included in, or performed by, multiple devices, as in the configurations shown in FIG. 2 or other configurations not shown. For example, the account manager 253 and the communication unit 254 can be included in the wagering game machine 260 instead of, or in addition to, being a part of the wagering game server 250. Further, in some embodiments, the wagering game machine 260 can determine wagering game outcomes, generate random numbers, etc. instead of, or in addition to, the wagering game server 250.

The wagering game machines described herein (e.g., wagering game machine 260) can take any suitable form, such as floor standing models, handheld mobile units, bartop models, workstation-type console models, surface computing machines, etc. Further, wagering game machines can be primarily dedicated for use in conducting wagering games, or can include non-dedicated devices, such as mobile phones, personal digital assistants, personal computers, etc.

In some embodiments, wagering game machines and wagering game servers work together such that wagering game machines can be operated as thin, thick, or intermediate clients. For example, one or more elements of game play may be controlled by the wagering game machines (client) or the wagering game servers (server). Game play elements can include executable game code, lookup tables, configuration files, game outcome, audio or visual representations of the game, game assets or the like. In a thin-client example, the wagering game server can perform functions such as determining game outcome or managing assets, while the wagering game machines can present a graphical representation of such outcome or asset modification to the user (e.g., player). In a thick-client example, the wagering game machines can determine game outcomes and communicate the outcomes to the wagering game server for recording or managing a player's account.

In some embodiments, either the wagering game machines (client) or the wagering game server(s) can provide functionality that is not directly related to game play. For example, account transactions and account rules may be managed centrally (e.g., by the wagering game server(s)) or locally (e.g., by the wagering game machines). Other functionality not directly related to game play may include power management, presentation of advertising, software or firmware updates, system quality or security checks, etc.

Furthermore, the wagering game system architecture 200 can be implemented as software, hardware, any combination thereof, or other forms of embodiments not listed. For example, any of the network components (e.g., the wagering game machines, servers, etc.) can include hardware and machine-readable storage media including instructions for performing the operations described herein.

Example Operations

This section describes operations associated with some embodiments. In the discussion below, some flow diagrams are described with reference to block diagrams presented herein. However, in some embodiments, the operations can be performed by logic not described in the block diagrams.

In certain embodiments, the operations can be performed by executing instructions residing on machine-readable storage media (e.g., software), while in other embodiments, the operations can be performed by hardware and/or other logic (e.g., firmware). In some embodiments, the operations can be performed in series, while in other embodiments, one or more of the operations can be performed in parallel. Moreover, some embodiments can perform more or less than all the operations shown in any flow diagram.

Figure 3:
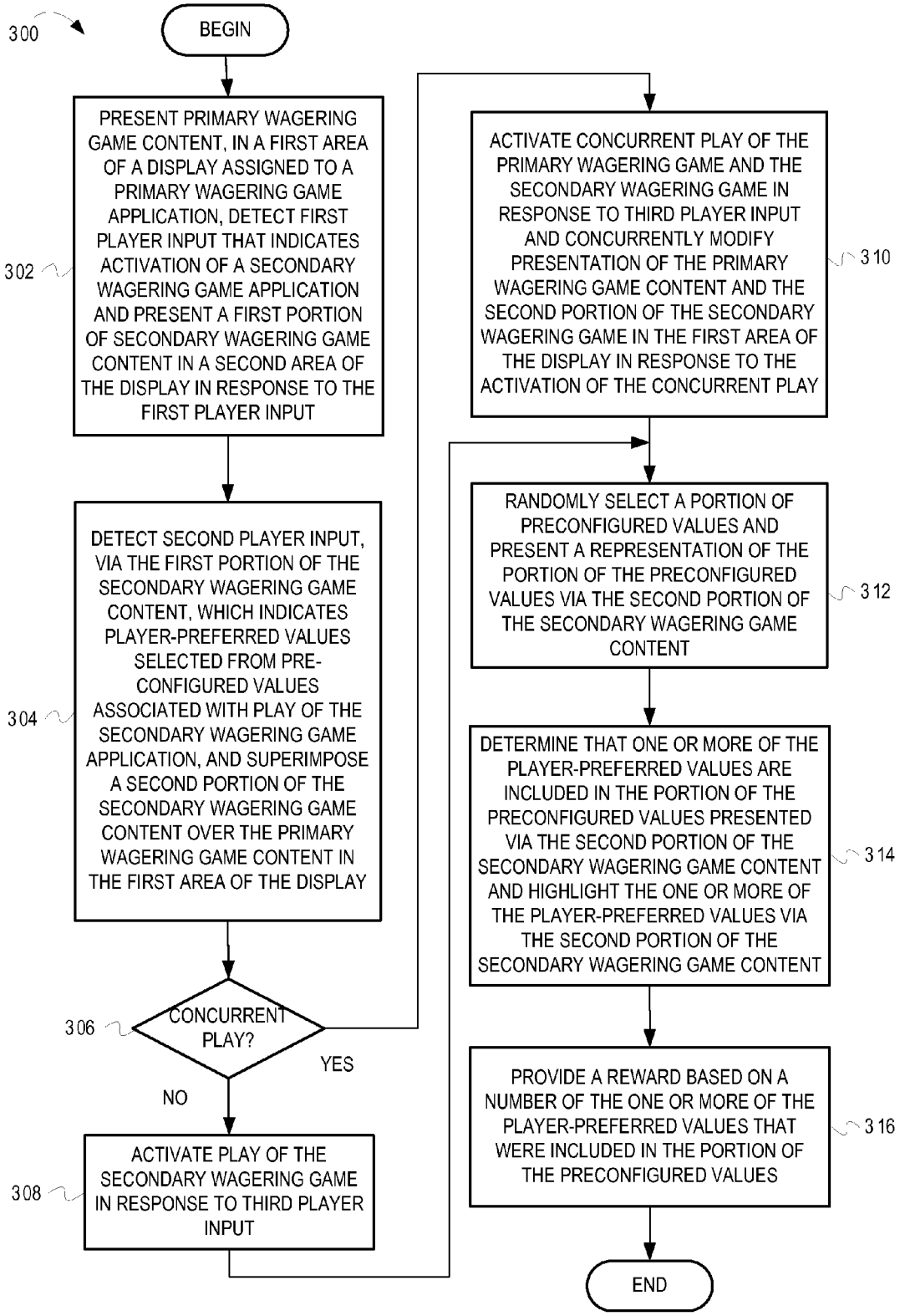
FIG. 3 is a flow diagram 300 illustrating dynamically overlaying and controlling a secondary wagering application concurrently with controlling and presenting a primary wagering game application, according to some embodiments.
Figure 4:
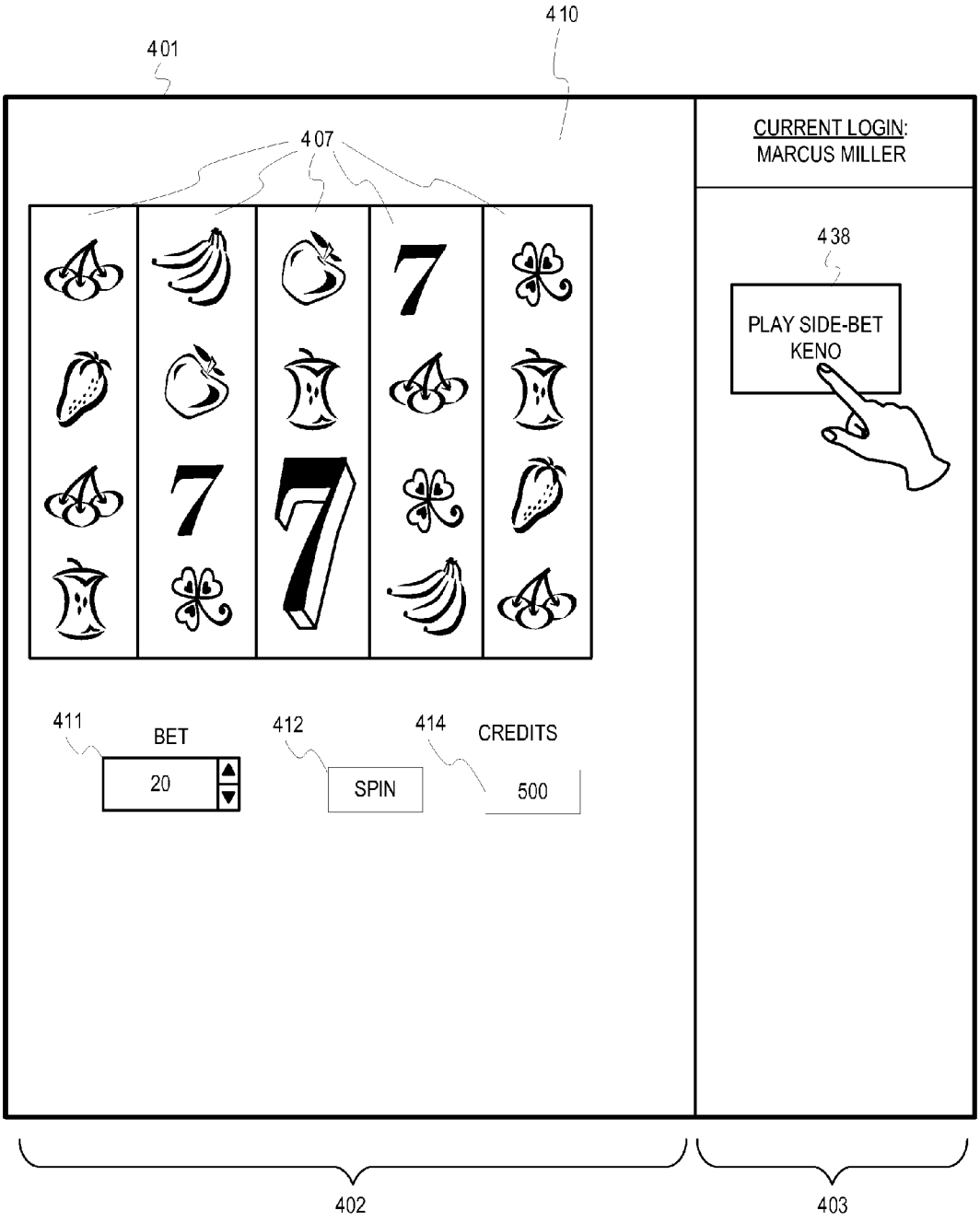
FIGS. 4-8 are illustrations of dynamically overlaying presentation and function of a Keno-type, secondary wagering game application with a slot-style, primary wagering game application, according to some embodiments.
Figure 5:
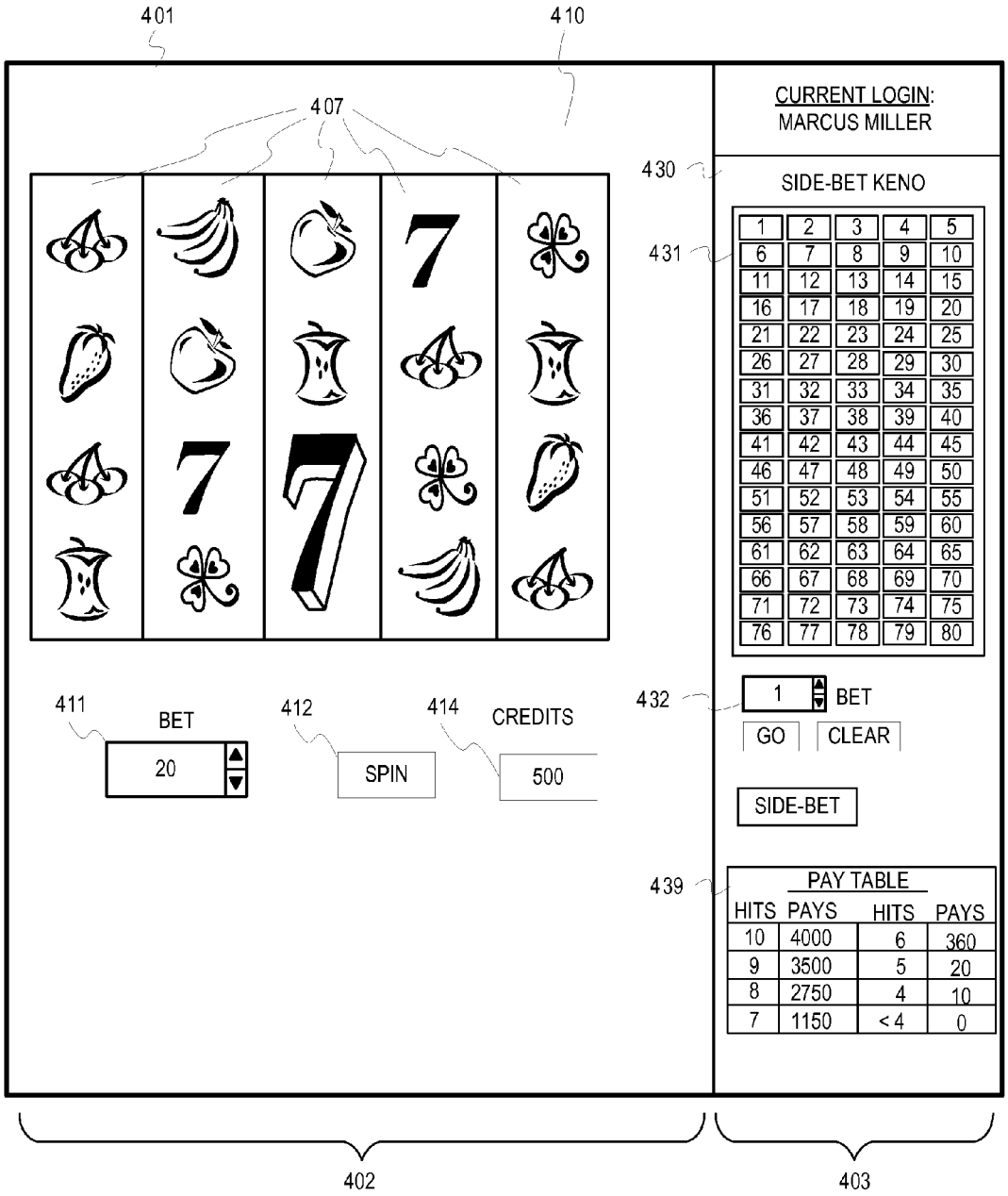
Figure 9:
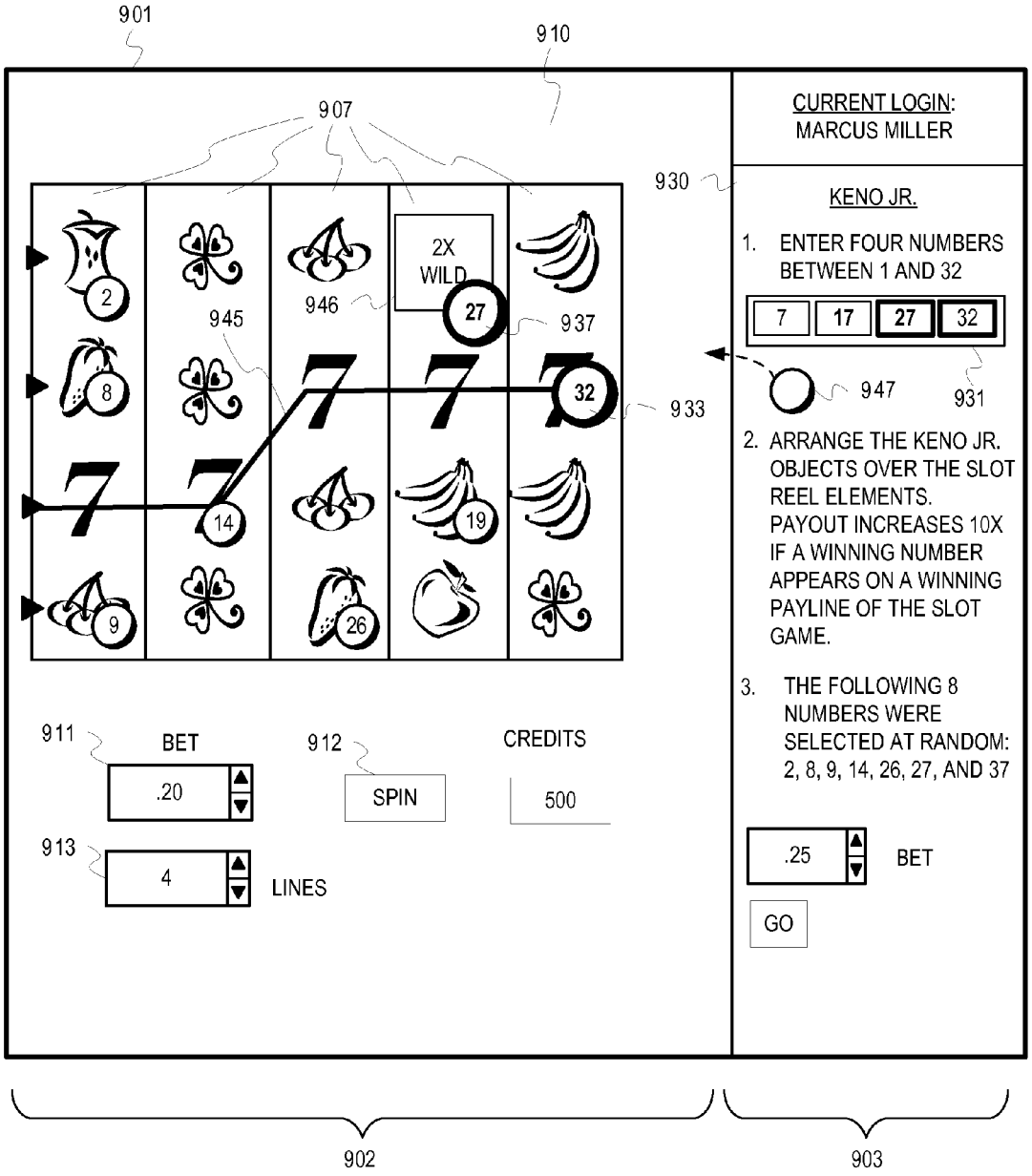
FIG. 9 is an illustration of dynamically overlaying presentation and controlling a Keno-type, secondary wagering game application secondary application with a slot-style, primary wagering game application, according to some embodiments.

FIG. 3 is a flow diagram ("flow") 300 illustrating dynamically overlaying and controlling a secondary wagering application concurrently with controlling and presenting a primary wagering game application, according to some embodiments. FIGS. 4-8, 9 and 10 are conceptual diagrams that help illustrate the flow of FIG. 3, according to some embodiments. FIGS. 4-8 illustrate dynamically overlaying presentation and function of a Keno-type, secondary wagering game application with a slot-style, primary wagering game application, according to some embodiments. FIG. 9 also illustrates dynamically overlaying presentation and function of a Keno-type, secondary wagering game application with a slot-style, primary wagering game application, according to some embodiments. FIG. 10 illustrates dynamically overlaying presentation and function of a Poker-type, secondary wagering game application with a slot-style, primary wagering game application, according to some embodiments. This description will present FIG. 3 in concert with FIGS. 4-8, 9 and 10.

In FIG. 3, the flow 300 begins at processing block 302, where a wagering game system ("system") presents primary wagering game content, in a first area of a display assigned to a primary wagering game application, detects first player input that indicates activation of a secondary wagering game application and presents a first portion of secondary wagering game content in a second area of the display in response to the first player input. For example, in FIG. 4, for example, system presents primary wagering game content ("primary content") 410 in a first area 402 of a display 401 (e.g., a graphical user interface, a monitor, a window, etc.) for a primary wagering game application ("primary wagering game"). The primary content 410 includes a plurality of playing elements, such as reel symbols presented on a plurality of reels 407. The primary content 410 can also include a bet meter 411 that indicates a betting, or wager, amount associated with a primary wagering game (e.g., for each spin of a slot game). The primary content 410 also include a spin control 412, which will cause the reels 407 to spin randomly, according to a random number generation, and come to rest in a reel-stop position that will indicate an outcome for the slot game during one playing turn. The amount in the bet meter 411 is transacted for playing the one playing turn. A pay table for the primary wagering game indicates specific reel-stop configurations, with specific reel symbol combinations, that qualify as winning results for the playing turn. The primary wagering game will payout different amounts for the different reel-stop configurations and specific reel symbol combinations to odds associated with the pay table and based on an amount the wager indicated in the bet meter 411. Any amounts wagered are deducted from a credit meter 414, which indicates a monetary balance for a wagering game session. The credits can be stored and/or transferred to and from a wagering game player account ("player account") which a player uses, in some examples, to track funds wagered and won during the wagering game session. During the wagering game session the system can detect a selection of a control, such as the control 438 presented in a second area 403 of the display 401. When the system detects the activation of the control 438 the system presents secondary wagering game content. For example, in FIG. 5 the system presents secondary wagering game content ("secondary content") 430 within the second area 403. The secondary content 430 can include a grid 431 that specifies a plurality of numbers for a player to select during a Keno game. Keno is a lottery style game that randomly selects, or "draws" values from a set of possible, pre-configured values, such as the numerical values from "1" to "80" shown in the grid 431. A player can select a small subset from the pre-configured values according to Keno rules. For example, a pay table 439 associated with the Keno game indicates that up to ten of the eighty pre-configured values can be selected by a player. Later, the Keno game will select twenty random values from the eighty pre-configured values, and then compare those values against the ten values selected by the player. Depending on a number of values that match (i.e., "hits") the Keno game can pay out a reward as specified in the pay table 439. A betting control 432 indicates an amount of a bet to wager on each playing turn for the Keno game. The reward amounts specified in the pay table 439 may vary based on the amount of the wager indicated in the betting control 432. The betting control 432, therefore, is separate from the betting control 411, and computations for the primary wagering game (i.e., the slot game), and its pay table mathematics, can be independent from computations for the secondary wagering game and its pay table mathematics. In other words, the primary wagering game and the secondary wagering game can be separate applications that utilize separate and independent processing (e.g., via different threads), algorithms, game assets, libraries, etc.

Figure 6:
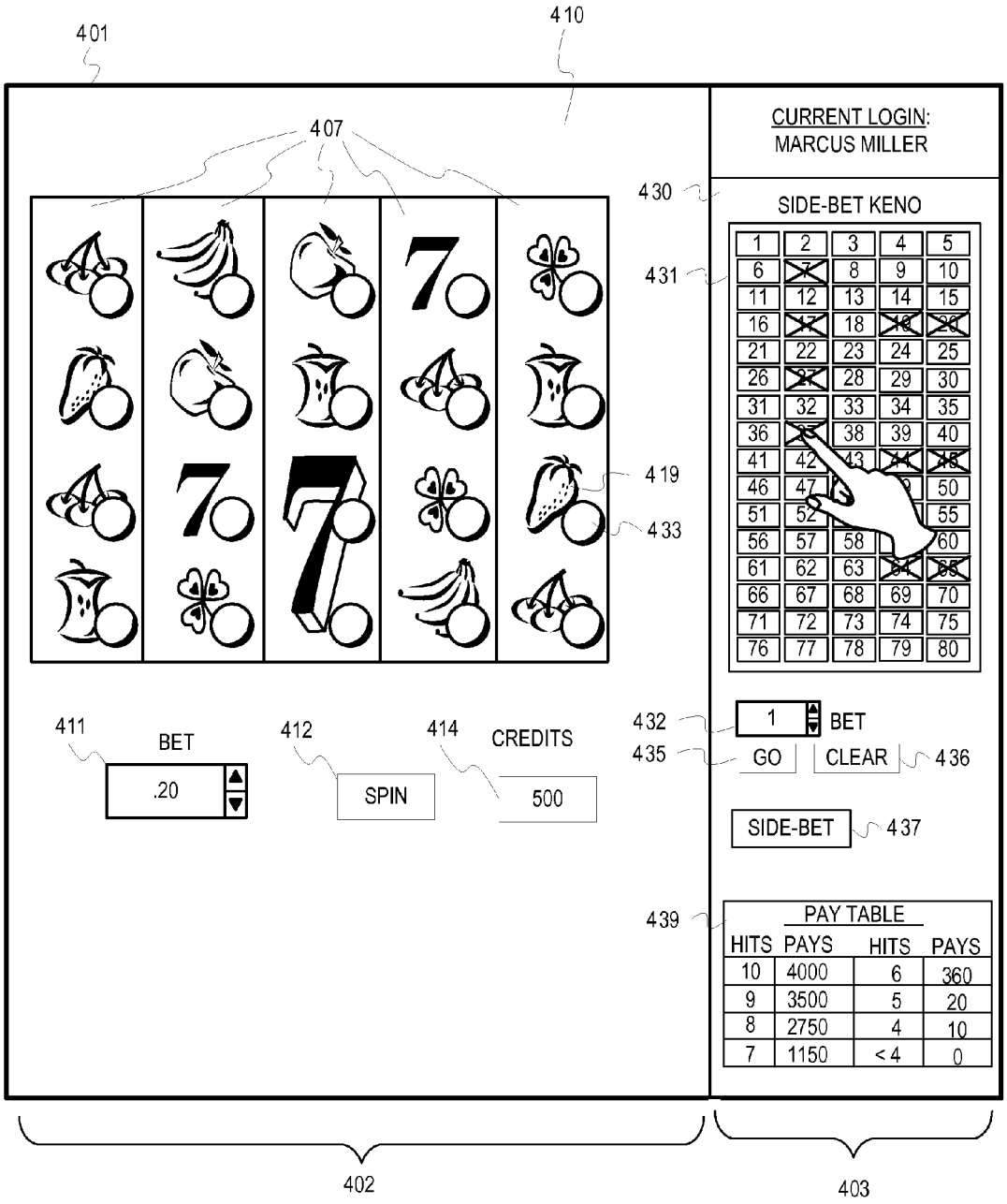

The flow 300 continues at processing block 304, where the system detects second player input, via the first portion of the secondary wagering game content, which indicates player-preferred values selected from pre-configured values associated with play of the secondary wagering game application, and superimposes a second portion of the secondary wagering game content over the primary wagering game content in the first area of the display. The first portion of the secondary wagering game content is configured to indicate player-preferred values associated with play of the secondary wagering game application. The player-preferred values are a subset of a plurality of preconfigured values from which to select randomly during the play of the secondary wagering game application. In FIG. 6, for instance, the grid 431 includes controls configured to detect player input. The controls are selectable graphics that display the plurality of preconfigured values (e.g., display the values from "1" to "80"). The selectable graphics respond to player input, such as to a player's touch against a touch-screen. The player can select only a portion, or a limited number, of the pre-configured values for a playing turn of the Keno game (e.g., the grid 431 will only accept ten user-selections of the values from "1" to "80). For example, in FIG. 6, the player selects the ten values "7," "17," "19," "20," "27," "37," "44," "45," "64," and "65." The system marks those values on the grid 431 using "x" symbols. A button 436 can clear the player-selections from the grid 431. The values associated with selected graphics may be referred to as "player-preferred" values because the player preferred those values, and thus selected them, for the playing turn of the Keno game. The system will, subsequently during the playing turn of the Keno game, select at random from the pre-configured values of the grid 431 (e.g., the system will, subsequently, select at random twenty of the values from "1" to "80" specified in the grid 431). In other embodiments, such as shown in FIG. 9, a secondary game does not need to have selectable graphics, but can have other ways of detecting player-preferred values. For instance, input fields 931 can receive typed input, to specify numbers within a specified range of pre-configured values. Returning again to FIG. 6, the system superimposes a portion of secondary content associated with the Keno game over one or more of the playing elements (e.g., over reel symbols) of the primary content 410 in the first area of the display. For example the system superimposes one or more objects, such as object 433, which depicts a graphical representation of a Keno ball. The system can superimpose the objects (e.g., object 433) in response to player input, such as via selection of the button 437. The objects are initially empty (i.e., the objects depict no values). The system can map, or assign, first coordinates, or first locations, for the objects to second coordinates, or second locations, of the symbols on the reels 407 or to a point in proximity to the symbols on the reels 407. The system can lock positions of the objects in the first locations to the associated second locations. The system, as similarly described previously in FIG. 1, can lock the positions of the objects to a transparent presentation layer, associated with the secondary wagering game application. The transparent, presentation layer overlays a portion of a presentation layer that corresponds to the first area 402 of the display. In some embodiments, the number of objects corresponds to a number of the playing elements (e.g., twenty Keno balls correspond to the twenty reel symbols on the reels 407). In other embodiments, the system maps the locations of the objects to locations of the primary wagering game content that do not necessarily correspond to a specific wagering game element (e.g. that do not necessarily correspond to one particular reel symbol). For example, if there were only three reels instead of five, then only twelve reel symbols would be visible. The system, however, would, in one embodiment, place twenty Keno ball graphics over the reels in a configuration that spread out the placement of the Keno balls in a way that did not have a one-to-one correlation with the reel symbols.

In some embodiments, placement of the second portion (e.g., objects such as object 433) of secondary content 430 is independent of symbols, numbers, or other values for the playing elements of the primary content 410 or of a relationship between playing elements of the primary content 410. For instance, the object 433 is placed at a coordinate associated with the reel symbol 419; however the placement of the object 433, in one embodiment, is independent of the image, value, potential value, etc. associated with the reel symbol 419. Other embodiments, however, can detect and use characteristics of the symbols, and/or relationship of the symbols, in placing the objects, controlling game functions, generating rewards, etc. for the secondary content, for example, as illustrated in FIG. 9, described further below.

Further, the system communicates state data, hardware data, playing element values, bet data, etc. between a primary wagering game application and the secondary wagering game application. For example, the system can determine primary game data from the primary wagering game application concerning locations (e.g. coordinates for reel symbols), state (e.g., spin start events, spin end events, idle states of the reels, reel spin timing, etc.), properties (e.g., reel configuration values, numbers of reels, etc.), content types (e.g., reel shapes, themes, etc.), physics (e.g., reel speeds, reel mass, etc.), bet denomination, credit balance, or other information about the primary wagering game and use the primary game data to control the secondary wagering game application (e.g., to position the transparent layer associated with the secondary wagering game application, to map the objects to the positions on the reels, to determine a minimum bet value for the secondary wagering game, to communicate secondary wagering game outcome values to the primary wagering game and vice-versa, etc.). The system further communicates capabilities, properties, etc. of each of the games (e.g. wagering versus non-wagering properties). The system can subscribe to data from the primary wagering game application and the secondary wagering game application.

The flow 300 continues at processing block 306, where the system determines whether a request is made to concurrently play the primary wagering game application and the secondary wagering game application. If, at processing block 306, a request is not made to concurrently play the primary wagering game application and the secondary wagering game application, the flow 300 continues at processing block 308, where the system activates play of only the secondary wagering game in response to third player input. For example, the system can cause the secondary wagering game application to play one or more turns independently from play for the primary wagering game application (e.g., if a player does not select the button 437 and uses the button 435). The system does not have to perform a playing turn for the secondary wagering game application concurrently with a playing turn of the primary wagering game application. The flow 300 would then continue at processing block 312 as described further below.

Figure 7:
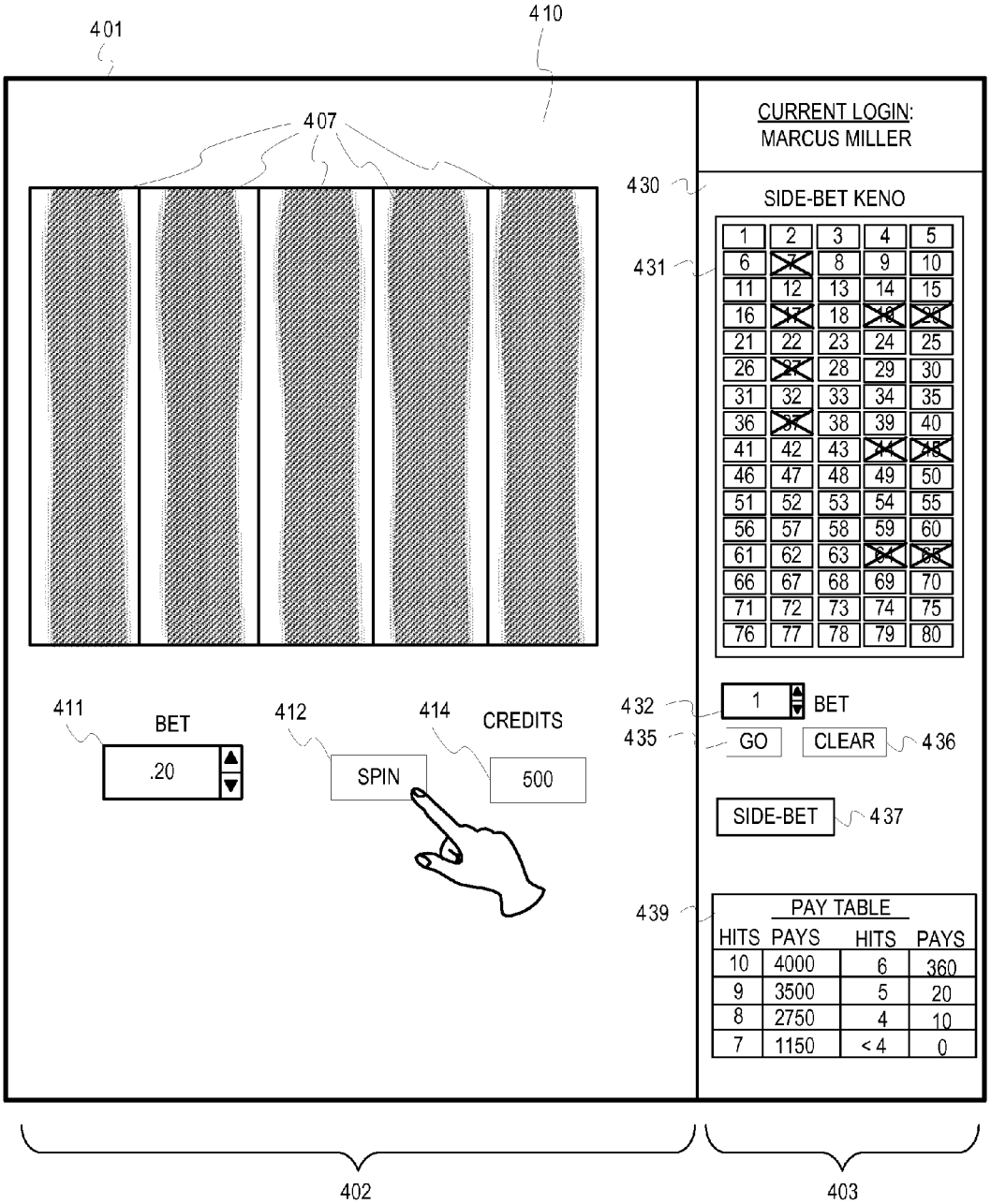
Figure 8:
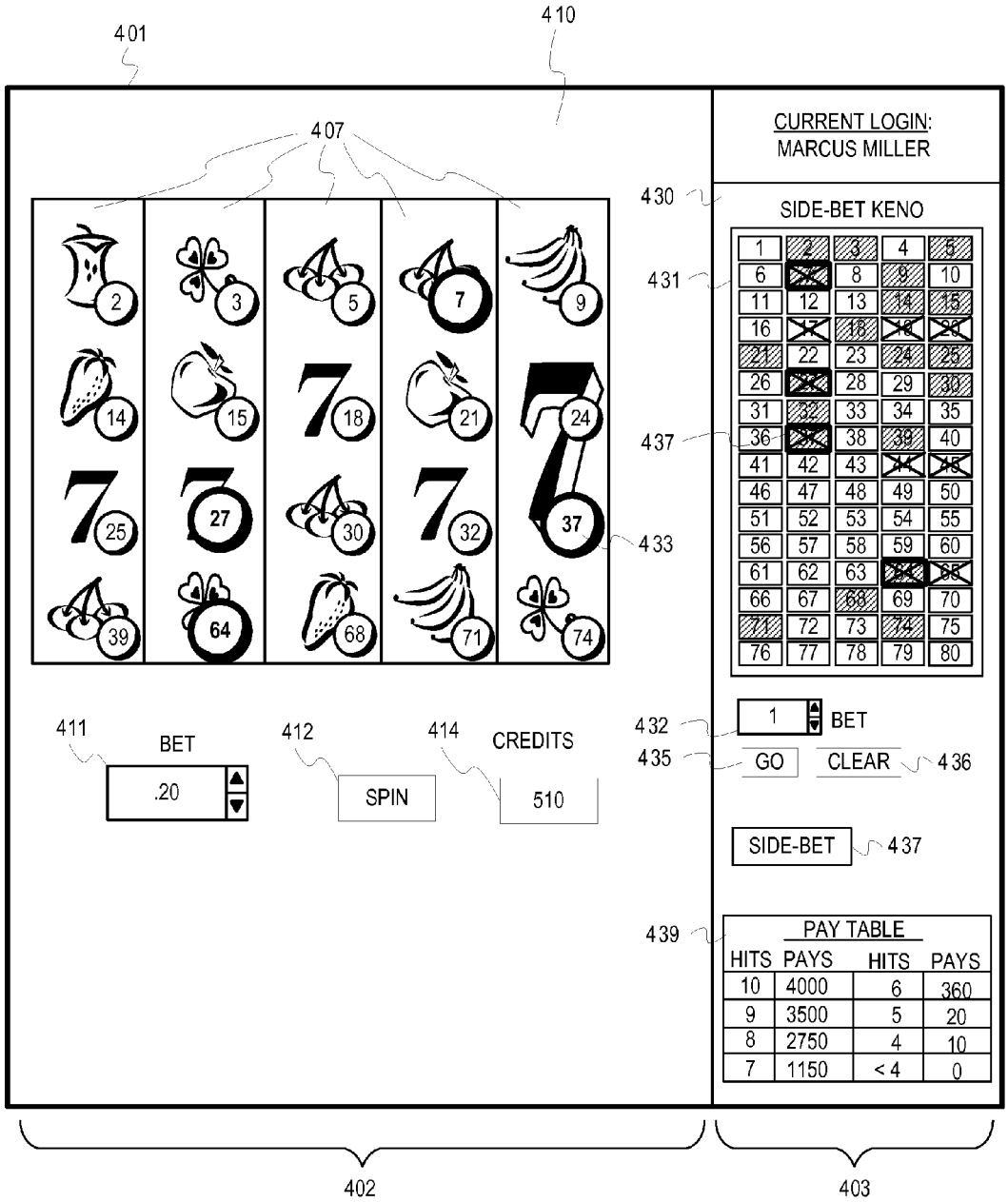

If, however, at processing block 306, a request is made to concurrently play the primary wagering game application and the secondary wagering game application, the flow 300 continues at processing block 310. At processing block 310, the system activates concurrent play of the primary wagering game and the secondary wagering game in response to third player input and concurrently modifies presentation of the primary wagering game content and the second portion of the secondary wagering game in the first area of the display in response to the activation of the concurrent play. In some embodiments, a player input for either the primary wagering game application or the secondary wagering game application can initiate concurrent play. For instance, as shown in FIG. 7, pressing the spin button 412 for the primary wagering game application can indicate concurrent play for both the primary wagering game and the secondary wagering game. The button 437 can further indicate a request for simultaneous play. Activating a control associated with the secondary wagering game (e.g., pressing the button 435) may activate play for only the secondary wagering game application, unless a player preference is set to make the activation of the button 435 also indicate a concurrent play request. The concurrent play for the primary wagering game application and the secondary wagering game application can include receiving independent bets for each game and initiating playing turns for both the primary wagering game and the secondary wagering game, at approximately the same time and/or during overlapping presentation periods.

The system can concurrently modify presentation of the primary wagering game content and the second portion of the secondary wagering game in the first area of the display by causing simultaneous movement, change, etc. of the playing elements of the primary wagering game content and the second portion of the secondary wagering game content within the first area of the display during the concurrent activation of the play of the primary wagering game and the secondary wagering game. For example, referring to FIG. 7, the system cause the superimposed objects to move in unison with the playing elements of the primary wagering game content in their locked positions relative to playing elements of the primary wagering game content (e.g., cause the object 433 to spin in a locked location relative to reel symbol 419 as the reel symbols appear to move on/with the reels 407). The movement of the reels 407 is associated with a visual depiction of randomization of the playing elements of the primary content 410.

The flow 300 continues at processing block 312, where the system randomly selects a portion of the preconfigured values and presents a representation of the portion of the preconfigured values via the second portion of the secondary wagering game content. In some embodiments, the random selection of the number of the player-preferred values for the secondary wagering game is independent of random number generation associated with the primary wagering game. Further, the system can present the number of the player-preferred values on the second portion of the secondary wagering concurrently with presentation of a randomly selected configuration of the playing elements of the primary wagering game content (e.g., playing turns for primary wagering game and secondary wagering appear to end at approximately the same moment, such as when slot-reels stop spinning, and remain in same state until an additional playing turn occurs). For example, in FIG. 7, while the reels 407 spin, the system selects twenty values at random between "1" and "80." Then, in FIG. 8, after the reels 407 stop spinning, the reels 407 depict a randomized configuration of symbols for the primary content 410 and the system also reveals the twenty randomly selected values for the Keno game. For instance, the system depicts, within the grid 431, the twenty values, each having a shaded box (i.e., the numbers "2," "3," "5," "7," "9," "14," 15," 18, "21," "24," "25," "27," "30," "32," "37," "39," "64," "68," "71," and "74"). The system also presents the twenty randomly selected values on the objects (i.e., on the object 433 and all other Keno ball objects previously superimposed over the reels 407).

The flow 300 continues at processing block 314, where the system determines that one or more of the player-preferred values are included in the portion of the preconfigured values presented via the second portion of the secondary wagering game content and highlights the one or more of the player-preferred values via the second portion of the secondary wagering game content. For example, in FIG. 8, the system determines that one or more of the player-preferred values (i.e., the values in the grid 431 that are marked by the "x" symbol) are equivalent in value to one of the randomly selected twenty values (i.e., the values in the grid 431 that are marked by the shading). The system determines that four of the values are equivalent, the values "4," "27," 37," and "64." The system modifies the appearance and/or behavior (e.g., changes color, size, border, effect, etc.) of objects that correspond to the equivalent values "4," "27," 37," and "64." (e.g., the system increases the size of the object 433 which corresponds to the value of "37"). The system can also highlight, in the grid 431, the values "4," "27," 37," and "64" (e.g., by adding a thick border, such as border 437, to the value of "37" in the grid 431).

The flow 300 continues at processing block 316, where the system provides a reward based on a number of the one or more of the player-preferred values that were included in the portion of the preconfigured values. For example, in FIG. 8, according to the pay table, because four hits occurred (e.g., four player-preferred numbers matched four of the randomly selected values), then the player receives an award of ten credits. The system therefore awards ten credits to the session balance, and the credit meter 414 increases in number by ten credits.

Referring again to FIG. 3, in some embodiments, the system can provide the reward based on a characteristic of the second portion of the secondary wagering game content as well as characteristics of the playing elements. For example the system can provide the reward based on a position of objects in relation to playing elements for the primary wagering game content. For example, the system can determine that first locations for the one or more of the player-preferred values coincide with second locations of one or more portions of the playing elements of the primary wagering game content that comprise a winning outcome for the primary wagering game. The system can, thus, determine a value for the reward based on the first locations coinciding with the second locations. For example, in FIG. 9, the system presents a secondary wagering game (e.g., an additional Keno-type game) via the display 901, with a first portion of secondary content 930 in area 903 of the display 901 and a second portion of the secondary content 930 in the area 902, superimposed over portions of the reels 907. The additional Keno-type game requires the player to drag depictions of an "empty" object 947 onto specific symbols on reels 907. According to game rules, if the player arranges a depiction of the object 947 onto a reel symbol that, after activation of a playing turn, is part of a payline 945 for the primary content 910, then the system increases a reward for either the primary content 910 or the secondary content 930 by a multiplier. For instance, prior to the reel spin, a bet meter 911 indicates a specific bet value for each of four paylines, indicated by a payline meter 913. The system detects an activation of the spin button 912, which causes the reels 907 to spin. After the reels 907 stop spinning, the reels 907 show the randomized elements for the playing turn of the primary content 910. The secondary content 930 also randomly selects eight Keno values and places them on the objects superimposed on the reels 907 (e.g., the object 933). Two of the player's preferred valued (e.g., the values "27," and "32," as specified previously in the input fields 931) match up, or equate, to two of the eight Keno values placed on the secondary content objects. The object 933, for example, indicates the value of "32." Further, according to the outcome for the primary content 910, one payline 945 wins. Thus, based on the game rules for the secondary wagering game, because the object 933 is associated with a reel symbol that is part of the winning payline 945, the system increases a value for the reward for either the primary wagering game or the secondary wagering game.

Returning momentarily to FIG. 3, in another example, the system can provide the reward based on a property or appearance of second portion of secondary wagering game content. For instance, one or more of the secondary content objects can appear as a different color, shape, behavior etc. from the remainder of the other secondary content objects (e.g., a golden ball amongst white balls, a sparkling ball amongst non-sparkling balls, etc.). The different in characteristic can, for example, result in a multiplier to one or more of the primary wagering game or the secondary wagering game. In yet another example, the system can provide the reward based on a value of a primary wagering game playing element. For example, in FIG. 9, the playing element 946 has a certain value (e.g. a 2X wild symbol) and an object 937 is a winning value for the secondary content 930. The system, therefore, modifies the reward accordingly (e.g.

multiplies the reward for the secondary wagering game by a factor of 2 because of the 2× value of the playing element 946).

Additional Example Embodiments

According to some embodiments, a wagering game system ("system") can provide various example devices, operations, etc., to dynamically overlay and control wagering game content. The following paragraphs enumerate some possible embodiments.

In some embodiments, the system can position secondary wagering game content according to player preferences and player input. In some embodiments, the system can remove, minimize, miniaturize, slide, modify, etc., first or second portions of secondary wagering game content (e.g. minimize or remove positions of the objects on a display, minimize a pay table, miniaturize a grid while minimizing all other elements of secondary wagering game content, etc.). For example, the system can provide controls to hide (e.g., minimize) the Keno ball objects when superimposed over the primary content (e.g., deselect the button 437). In some embodiments, the system can move a grid item out of a secondary content container to a position associated with the primary wagering game content. For instance, a player can miniaturize, drag, and dock, a secondary container (e.g., the grid 431) to a portion of an area of a display (e.g., the first area 403) associated with the primary wagering game content, such as over a portion of the reels. In some embodiments, the system can insert objects in response to player touch, move objects in response to player input via instruments and controls, move objects in response to player's finger movements on a screen (e.g., drag and drop), etc. For example, as described above for FIG. 9, the system moves the object 947 onto the first area 902 in response to a drag and drop input from a player.

In some embodiments, the system can present multiple transparent layers and/or opaque layers of games and bring one of the games to a top layer, or forefront, based on game related events. For example, a player may select multiple Keno cards and play each of the Keno games simultaneously. The multiple Keno games can also play concurrently with play of a primary wagering game. The system stacks the multiple Keno cards upon each other and stacks their respective object sets (e.g., stacks sets of Keno ball objects for each of the Keno games upon each other) in an area of a display associated with the primary wagering game content so that only one set is seen at a time on the top layer. If a win event occurs to one of the Keno game instances that is stacked below the top layer, the system automatically moves the Keno ball objects for the winning game to the top layer. In another embodiment, the system can stack secondary game objects, such as Keno grids.

In some embodiments, the system can place secondary content in multiple displays, such as in an area associated with a peripheral display or a top box. In some embodiments the system can overlay secondary content associated with a group game, or community game feature, on multiple displays associated with multiple wagering game machines.

In some embodiments, the system adjusts presentation of overlaid secondary content to physics and/or game properties of primary content. For example, a primary wagering game may be configured to hold steady one or more reels of a primary wagering game while spinning other reels. The system can detect the properties of the reels via query of the primary wagering game's properties before each spin to determine what the primary wagering game application plans to do with the reels. The system can, thus, match movement of overlaid objects accordingly (e.g., cause some of the overlay objects to remain steady while others spin). In other embodiments, the system detects speed, mass, air density, or other virtual physical properties programmed into the primary wagering game that govern movement, action, behavior, etc. of primary wagering game elements. The system can use those physical properties of the primary wagering game to control movement, action, behavior, etc. of the secondary game objects that are overlaid onto the primary wagering game content. For example, if a reel spins at a given speed, the system can match the speed of movement of Keno ball objects. In another example, if a character in a primary wagering game moves around on a display, or one of the reel symbols experiences an animation that depicts movement, the system can, in response, cause the secondary objects (e.g., Keno ball objects, card objects, etc.) to move (e.g., as if moved by a breeze or as if movement to shrink away), modify shape (e.g., as if to morph temporarily into an object that has counteracting properties, such as to morph into a water drop to protect itself from a fiery character that appears in the primary wagering game content), etc.

In some embodiments, the system can present secondary objects according to a cascading reel operation. Cascading reel games reveal additional symbols that drop down if a winning combination takes place in the base game. For instance, if a player gets a winning symbol combination the system will payout for the winning symbol combination and then remove a set of the displayed symbols (e.g., remove some, or all, of the winning symbols, remove other displayed symbols, etc.) and symbols that were not removed will drop or shuffle downwards from their current position into the empty spaces that remain after the set of the displayed symbols were removed. If dropping or shuffling downward of the symbols that were not removed results in a winning symbol combination, the operations of removing and dropping/shuffling additional sets of symbols can repeat—with the possibility of multiple wins occurring consecutively. Accordingly, when the system removes the set, or additional sets, of symbols additional secondary objects can also drop/shuffle into place creating the ability to draw even more numbers. If, for example, a Keno ball matches a number that a player selected, then it would be marked for that game, however all other non-winning balls have the possibility of being replaced by the additional balls/numbers being drawn through the cascading feature. For example, if a symbol drops into a vacant space, and the vacant space was not a winning Keno number, then the system can randomly select another number from the set of possible numbers for the Keno game (e.g., randomly select a twenty-first number from the original eighty numbers in a Keno game). If one of the additionally selected random numbers matches a number that the player had selected, via their initial selection of Keno numbers, the system can payout out more according to a pay table for the Keno game.

In some embodiments, the system can fund progressives for primary wagering game based on wins in a secondary game. In some embodiments, the system can also fund second-screen bonuses, multipliers, base-screen modifiers, etc.

In some embodiments, the secondary wagering game can be any type of wagering game. In some embodiments, the secondary wagering game is a slot-type wagering game and the system superimposes reels, or portions of reels, for the secondary wagering game over primary wagering game content (e.g., over or next to reels for the primary wagering game). In some embodiments, the secondary wagering game is a Black Jack type game where the system overlays card hands over the primary wagering game content (e.g., a player uses cards randomly drawn and present over reels to beat a dealer's cards located in a side-bar). In another embodiment, the secondary wagering game is a Poker type game. For instance the secondary game can deal graphical representations of Poker cards over reels and other wagering game elements of the primary wagering game similar to the Keno type examples described. The Poker cards would replace the representation of some of the Keno balls within the area of the display assigned to the primary wagering game content. The number of cards, however, can be different. For example, instead of dealing twenty cards over twenty reel symbols, the system can deal five cards over some of the reel symbols. For instance, in FIG. 10, a display 1001 includes a first area 1002 and a second area 1003. The first area 1002 presents primary wagering game content ("primary content") 1010, which includes reels 1007, symbols on the reels, a bet meter 1011, a spin control 1012, a credit meter 1014, and a payline meter 1013. A secondary wagering game (e.g., a Poker-style game), presents secondary wagering game content ("secondary content") 1030, including a pocket hand 1031, a bet meter 1032, an activation control 1035, a side-bet control 1037, and a pay table 1049. In one embodiment, the system detects simultaneous activation of the reels 1007 and the secondary content 1030 (e.g., a player presses the spin control 1012 which is configured to activate a playing turn for both the primary content 1010 and secondary content 1030 if the side-bet control 1037 has been activated). Before the reels 1007 stop spinning, the system can randomly select five card values from a virtual deck. When the reels 1007 stop spinning and present a reel-stop configuration for the primary content 1010, the system can concurrently present card objects 1033 over one row of the symbols on the reels 1007 that display the randomly selected card values. Some of the cards in the row are highlighted (i.e., the "10 of Diamonds," the "9 of Clubs," the "8 of Clubs," and the "6 of Spades" are highlighted with a thick border), as well as one of the cards in the pocket hand 1031 (i.e., the "Seven of Diamonds") to indicate the highest hand combination (i.e., a "10-6 Straight") from the pocket hand 1031 and the card objects 1033. In some examples, the system can present multiple rows of cards for multiple concurrently running card games. For example, the secondary content 1030 may provide an option to have multiple deals for a single playing turn. Thus, the system could present multiple card objects for other rows of symbols on the reels 1007 to display results for those other hands (e.g., up to four hands with a separate one of the four rows of the reels for each of the four hands).

Additional Example Operating Environments

This section describes example operating environments, systems and networks, and presents structural aspects of some embodiments.

Wagering Game Machine Architecture

Figure 11:
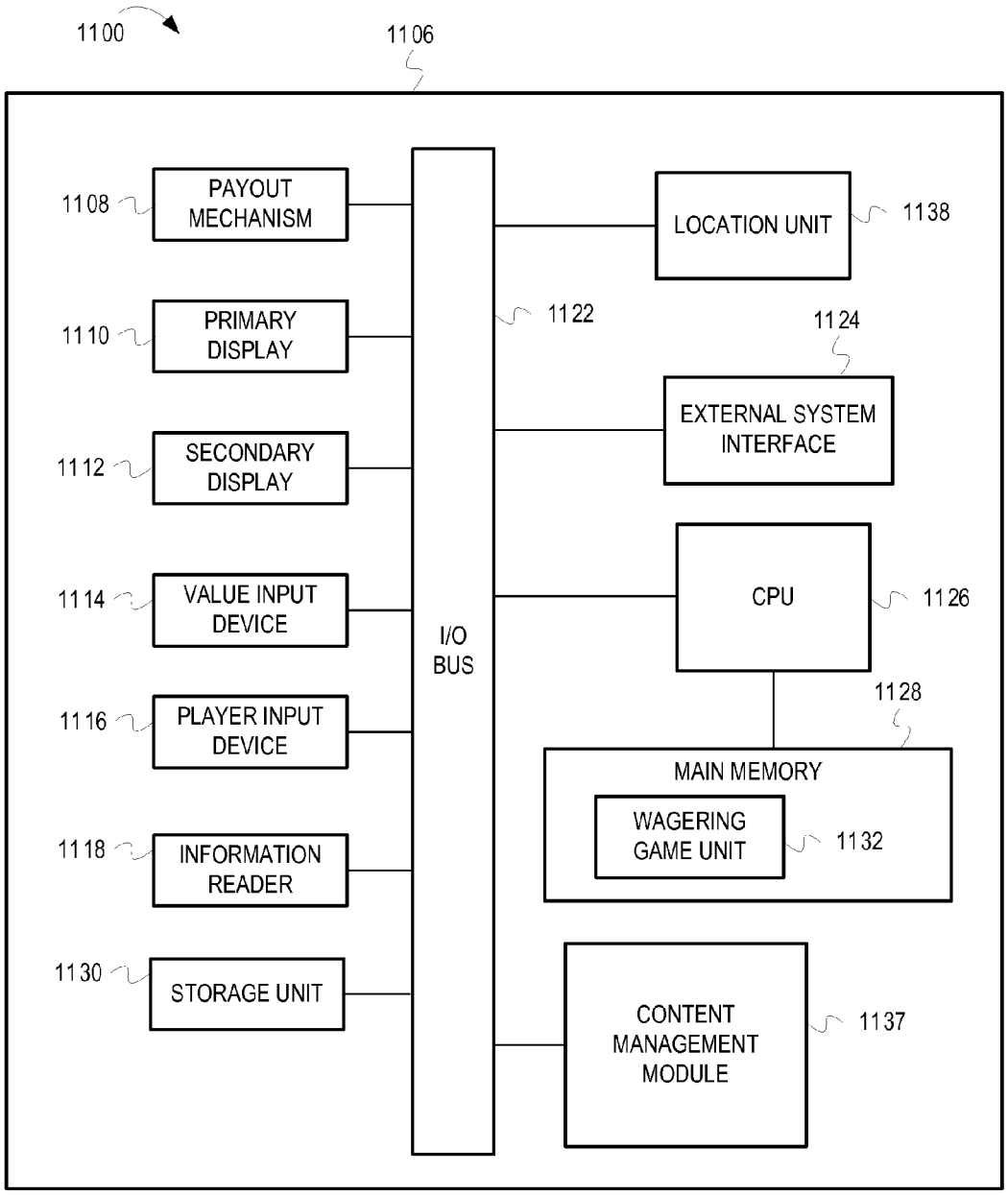
FIG. 11 is an illustration of a wagering game machine architecture 1100, according to some embodiments.

FIG. 11 is a conceptual diagram that illustrates an example of a wagering game machine architecture 1330, according to some embodiments. In FIG. 11, the wagering game machine architecture 1330 includes a wagering game machine 1106, which includes a central processing unit (CPU) 1126 connected to main memory 1128. The CPU 1126 can include any suitable processor, such as an Intel® Pentium processor, Intel® Core 2 Duo processor, AMD Opteron™ processor, or UltraSPARC processor. The main memory 1128 includes a wagering game unit 1132. In some embodiments, the wagering game unit 1132 can present wagering games, such as video Poker, video black jack, video slots, video lottery, reel slots, etc., in whole or part.

The CPU 1126 is also connected to an input/output ("I/O") bus 1122, which can include any suitable bus technologies, such as an AGTL+ frontside bus and a PCI backside bus. The I/O bus 1122 is connected to a payout mechanism 1108, primary display 1110, secondary display 1112, value input device 1114, player input device 1116, information reader 1118, and storage unit 1130. The player input device 1116 can include the value input device 1114 to the extent the player input device 1116 is used to place wagers. The I/O bus 1122 is also connected to an external system interface 1124, which is connected to external systems (e.g., wagering game networks). The external system interface 1124 can include logic for exchanging information over wired and wireless networks (e.g., 802.11g transceiver, Bluetooth transceiver, Ethernet transceiver, etc.)

The I/O bus 1122 is also connected to a location unit 1138. The location unit 1138 can create player information that indicates the wagering game machine's location/movements in a casino. In some embodiments, the location unit 1138 includes a global positioning system (GPS) receiver that can determine the wagering game machine's location using GPS satellites. In other embodiments, the location unit 1138 can include a radio frequency identification (RFID) tag that can determine the wagering game machine's location using RFID readers positioned throughout a casino. Some embodiments can use GPS receiver and RFID tags in combination, while other embodiments can use other suitable methods for determining the wagering game machine's location. Although not shown in FIG. 11, in some embodiments, the location unit 1138 is not connected to the I/O bus 1122.

In some embodiments, the wagering game machine 1106 can include additional peripheral devices and/or more than one of each component shown in FIG. 11. For example, in some embodiments, the wagering game machine 1106 can include multiple external system interfaces 1124 and/or multiple CPUs 1126. In some embodiments, any of the components can be integrated or subdivided.

In some embodiments, the wagering game machine 1106 includes a content management module 1137. The content management module 1137 can process communications, commands, or other information, where the processing can overlay primary and secondary content and control functions of the overlaid content.

Furthermore, any component of the wagering game machine 1106 can include hardware, firmware, and/or machine-readable storage media including instructions for performing the operations described herein.

Wagering Game Machine

Figure 12:
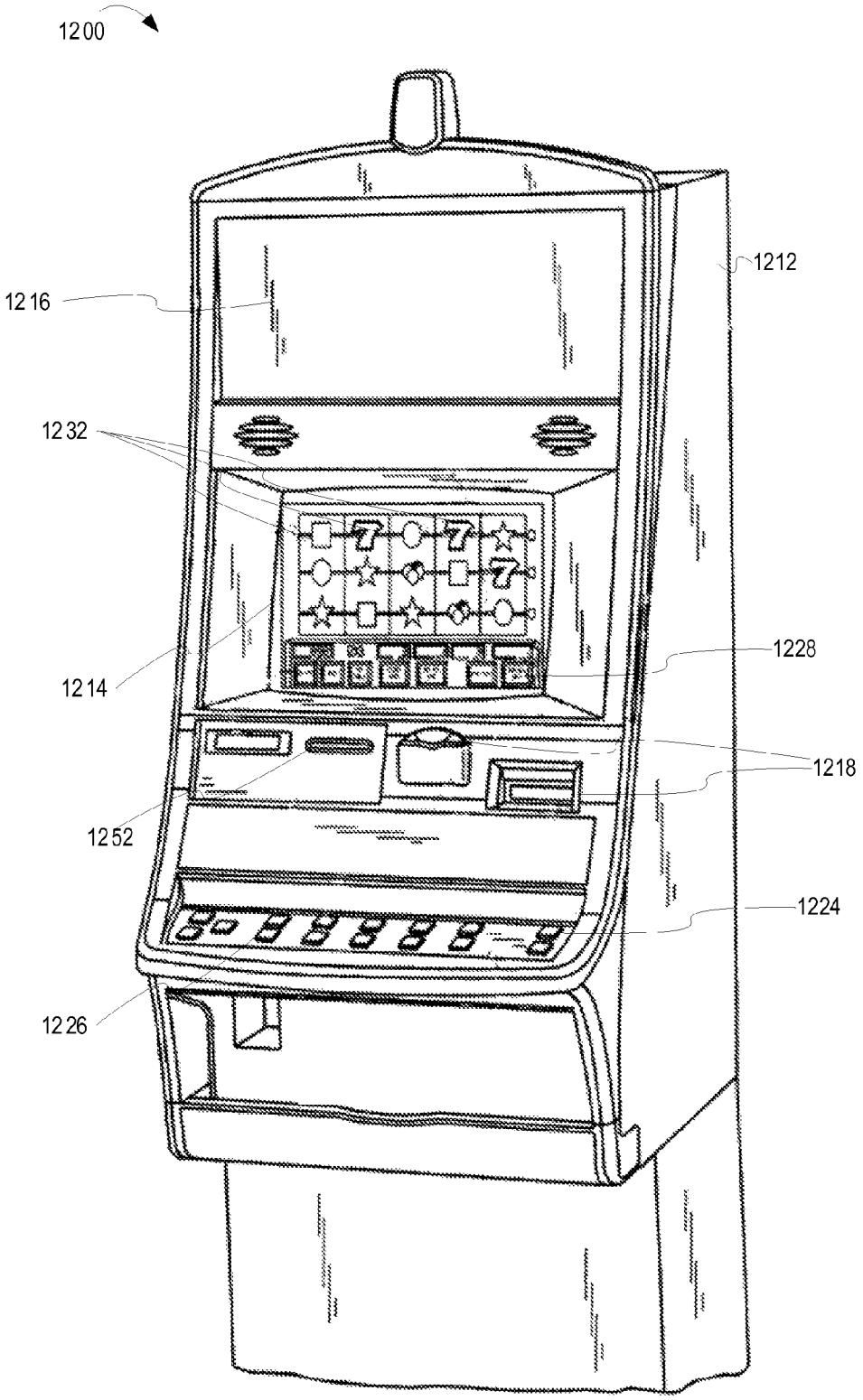
FIG. 12 is an illustration of a wagering game machine 1200, according to some embodiments.

FIG. 12 is a conceptual diagram that illustrates an example of a wagering game machine 1200, according to some embodiments. Referring to FIG. 12, the wagering game machine 1200 can be used in gaming establishments, such as casinos. According to some embodiments, the wagering game machine 1200 can be any type of wagering game machine and can have varying structures and methods of operation. For example, the wagering game machine 1200 can be an electromechanical wagering game machine configured to play mechanical slots, or it can be an electronic wagering game machine configured to play video casino games, such as blackjack, slots, keno, Poker, blackjack, roulette, etc.

The wagering game machine 1200 comprises a housing 1212 and includes input devices, including value input devices 1218 and a player input device 1224. For output, the wagering game machine 1200 includes a primary display 1214 for displaying information about a basic wagering game. The primary display 1214 can also display information about a bonus wagering game and a progressive wagering game. The wagering game machine 1200 also includes a secondary display 1216 for displaying wagering game events, wagering game outcomes, and/or signage information. While some components of the wagering game machine 1200 are described herein, numerous other elements can exist and can be used in any number or combination to create varying forms of the wagering game machine 1200.

The value input devices 1218 can take any suitable form and can be located on the front of the housing 1212. The value input devices 1218 can receive currency and/or credits inserted by a player. The value input devices 1218 can include coin acceptors for receiving coin currency and bill acceptors for receiving paper currency. Furthermore, the value input devices 1218 can include ticket readers or barcode scanners for reading information stored on vouchers, cards, or other tangible portable storage devices. The vouchers or cards can authorize access to central accounts, which can transfer money to the wagering game machine 1200.

The player input device 1224 comprises a plurality of push buttons on a button panel 1226 for operating the wagering game machine 1200. In addition, or alternatively, the player input device 1224 can comprise a touch screen 1228 mounted over the primary display 1214 and/or secondary display 1216.

The various components of the wagering game machine 1200 can be connected directly to, or contained within, the housing 1212. Alternatively, some of the wagering game machine's components can be located outside of the housing 1212, while being communicatively coupled with the wagering game machine 1200 using any suitable wired or wireless communication technology.

The operation of the basic wagering game can be displayed to the player on the primary display 1214. The primary display 1214 can also display a bonus game associated with the basic wagering game. The primary display 1214 can include a cathode ray tube (CRT), a high resolution liquid crystal display (LCD), a plasma display, light emitting diodes (LEDs), a three-dimensional (3D) display, or any other type of display suitable for use in the wagering game machine 1200. Alternatively, the primary display 1214 can include a number of mechanical reels to display the outcome. In FIG. 12, the wagering game machine 1200 is an "upright" version in which the primary display 1214 is oriented vertically relative to the player. Alternatively, the wagering game machine can be a "slant-top" version in which the primary display 1214 is slanted at about a thirty-degree angle toward the player of the wagering game machine 1200. In yet another embodiment, the wagering game machine 1200 can exhibit any suitable form factor, such as a free standing model, bar top model, mobile handheld model, or workstation console model.

A player begins playing a basic wagering game by making a wager via the value input device 1218. The player can initiate play by using the player input device's buttons or touch screen 1228. The basic game can include arranging a plurality of symbols 1232 along a pay line, which indicates one or more outcomes of the basic game. Such outcomes can be randomly selected in response to player input. At least one of the outcomes, which can include any variation or combination of symbols, can trigger a bonus game.

In some embodiments, the wagering game machine 1200 can also include an information reader 1252, which can include a card reader, ticket reader, bar code scanner, RFID transceiver, or computer readable storage medium interface. In some embodiments, the information reader 1252 can be used to award complimentary services, restore game assets, track player habits, etc.

Embodiments may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, embodiments of the inventive subject matter may take the form of a computer program product embodied in any tangible medium of expression having computer readable program code embodied in the medium. The described embodiments may be provided as a computer program product that may include a machine-readable storage medium having stored thereon instructions, which may be used to program a computer system to perform a process according to embodiments(s), whether presently described or not, because every conceivable variation is not enumerated herein. A machine-readable storage medium includes any tangible mechanism that stores information in a form readable by a machine (e.g., a wagering game machine, computer, etc.). For example, tangible machine-readable storage media includes read only memory (ROM), random access memory (RAM), magnetic disk storage media, optical storage media (e.g., CD-ROM), flash memory machines, erasable programmable memory (e.g., EPROM and EEPROM); etc. Some embodiments of the invention can also include machine-readable signal media, such as any media suitable for transmitting software over a network.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments, which are defined only by the appended claims. Each of the embodiments described herein are contemplated as falling within the inventive subject matter, which is set forth in the following claims.

The invention claimed is:

1. A method of operating a wagering game system, said method comprising:

electronically determining, via one or more electronic communication interfaces of the wagering game system, first display coordinates associated with first game content of a first wagering game application for presentation on an electronic display device associated with the wagering game system, wherein the first wagering game application is independent from a second wagering game application, and wherein monetary value for one or more of the first wagering game application or the second wagering game application is input via a value input device associated with the wagering game system;

automatically mapping, via an electronic processing device of the wagering game system, second game content for the second wagering game application to the first display coordinates; and based on the mapping, electronically presenting, via the electronic display device, the second game content affixed relative to the first game content during concurrent game play of the first wagering game application and the second wagering game application, wherein the first game content indicates a first game outcome independent from a second game outcome indicated by the second game content, and wherein a monetary reward associated with one or more of the first game outcome or the second game outcome is payable via a payout device associated with the wagering game system.

2. The method of claim 1, wherein the first game content comprises first game play elements, wherein the second game content comprises second game play elements, wherein the electronically determining the first display coordinates associated with the first game content comprises determining that each of the first display coordinates corresponds to each of at least a portion of the first game play elements, and wherein the automatically mapping the second game content to the first display coordinates comprises mapping each of the second game play elements to each of the first display coordinates.

3. The method of claim 1, wherein the first game content comprises an array of first game play elements, wherein the second game content comprises second game play elements, wherein the determining the first display coordinates associated with the first game content comprises determining first display coordinates within the array of first game play elements, and wherein the automatically mapping the second game content to the first display coordinates comprises mapping each of the second game play elements to each of the first display coordinates within the array of first game play elements.

4. The method of claim 1 further comprising detecting a characteristic of at least a first game play element of the first game content, and mapping at least a second game play element of the second game content to the first game play element according to the characteristic.

5. The method of claim 4, wherein the characteristic comprises one or more of a game state, game physics, and a game theme associated with the first wagering game application.

6. The method of claim 4, wherein the characteristic comprises a property of a symbol associated with the first game play element, wherein the symbol is associated with a pay table for the first wagering game application.

7. The method of claim 4 further comprising setting a value associated with the second game outcome based on the characteristic.

8. The method of claim 1 further comprising:

determining, via a game interface unit according to an electronic subscription of data from the first wagering game application, display data that corresponds to the first display coordinates.

9. The method of claim 1 further comprising:

electronically presenting, via the electronic processing device, a concurrent presentation of a playing round of the first wagering game application and a playing round of the second wagering game application, wherein first game play elements of the first game content move during the playing round of the first wagering game application, and wherein the electronically presenting the second game content affixed relative to the first game content comprises causing second game play elements of the second game content to move during the playing round of the second wagering game application in unison with movement of the first game play elements.

10. The method of claim 1, wherein the automatically mapping the second game content to the first display coordinates comprises positioning the second game content on a transparent display layer at second display coordinates that correspond to the first display coordinates, and wherein the electronically presenting the second game content affixed relative to the first game content comprises providing the transparent display layer to a graphics processing unit to graphically render a composite of the first game content with the transparent display layer.

11. The method of claim 1, wherein a first game award for the first game outcome is based on a first pay table of the first wagering game application, wherein a second game award for the second game outcome is based on a second pay table of the second wagering game application, and wherein the second pay table is independent from the first pay table.

12. One or more non-transitory, machine-readable storage media having instructions stored thereon, which when executed by a set of one or more electronic processing devices of a gaming system cause the gaming system to perform operations comprising:

electronically determining, via one or more electronic communication interfaces of the gaming system, first display coordinates associated with first game content of a first wagering game application for presentation on an electronic display device associated with the gaming system, wherein the first wagering game application is independent from a second wagering game application, and wherein monetary value for one or more of the first wagering game application or the second wagering game application is input via a value input device associated with the gaming system;

automatically mapping, via the set of one or more electronic processing devices, second game content for the second wagering game application to the first display coordinates; and causing the second game content to be electronically presented via the electronic display device according to the mapping, wherein the second game content is affixed relative to the first game content during concurrent game play of the first wagering game application and the second wagering game application, wherein the first game content indicates a first game outcome independent from a second game outcome indicated by the second game content, and wherein a monetary reward associated with one or more of the first game outcome or the second game outcome is payable via a payout device associated with the gaming system.

13. The one or more non-transitory, machine-readable storage media of claim 12, wherein the first game content comprises first game play elements, wherein the second game content comprises second game play elements, wherein the operations for electronically determining the first display coordinates associated with the first game content includes operations comprising determining that each of the first display coordinates corresponds to each of at least a portion of the first game play elements, and wherein the automatically mapping the second game content to the first display coordinates comprises mapping each of the second game play elements to each of the first display coordinates.

14. The one or more non-transitory, machine-readable storage media of claim 12, wherein the first game content comprises an array of first game play elements, wherein the second game content comprises second game play elements, wherein the operations for determining the first display coordinates associated with the first game content includes operations comprising determining first display coordinates within the array of first game play elements, and wherein the operations for automatically mapping the second game content to the first display coordinates includes operations comprising mapping each of the second game play elements to each of the first display coordinates within the array of first game play elements.

15. The one or more non-transitory, machine-readable storage media of claim 12, said operations further comprising:

determining, via a game interface unit according to an electronic subscription of data from the first wagering game application, display data that corresponds to the first display coordinates.

16. The one or more non-transitory, machine-readable storage media of claim 12, said operations further comprising:

electronically presenting, via the set of one or more electronic processing devices, a concurrent presentation of a playing round of the first wagering game application and a playing round of the second wagering game application, wherein first game play elements of the first game content move during the playing round of the first wagering game application, and wherein the operations for electronically presenting the second game content affixed relative to the first game content includes operations comprising causing second game play elements of the second game content to move during the playing round of the second wagering game application in unison with movement of the first game play elements.

17. The one or more non-transitory, machine-readable storage media of claim 12, wherein the operations for automatically mapping the second game content to the first display coordinates includes operations comprising positioning the second game content on a transparent display layer at second display coordinates that correspond to the first display coordinates, and wherein the electronically presenting the second game content affixed relative to the first game content includes operations comprising providing the transparent display layer to a graphics processing unit to graphically render a composite of the first game content with the transparent display layer.

18. The one or more non-transitory, machine-readable storage media of claim 12, wherein a first game award for the first game outcome is based on a first pay table of the first wagering game application, wherein a second game award for the second game outcome is based on a second pay table of the second wagering game application, and wherein the second pay table is independent from the first pay table.

19. A gaming system comprising:

one or more electronic processing devices;

an electronic display device; and one or more memory storage devices configured to store instructions, which when executed by at least one of the one or more electronic processing devices cause the gaming system to perform operations to electronically determine, via one or more electronic communication interfaces of the gaming system, first display coordinates associated with first game content of a first wagering game application for presentation on the electronic display device associated with the gaming system, wherein the first wagering game application is independent from a second wagering game application, and wherein monetary value for one or more of the first wagering game application or the second wagering game application is input via a value input device associated with the gaming system, automatically map, via an electronic processing device of the gaming system, second game content for the second wagering game application to the first display coordinates, and cause the second game content to be electronically presented via the electronic display device according to the mapping, wherein the second game content is affixed relative to the first game content during concurrent game play of the first wagering game application and the second wagering game application, wherein the first game content indicates a first game outcome independent from a second game outcome indicated by the second game content, and wherein a monetary reward associated with one or more of the first game outcome or the second game outcome is payable via a payout device associated with the gaming system.

20. The gaming system of claim 19, wherein the one or more memory storage devices are configured to store instructions, which when executed by at least one of the one or more electronic processing devices cause the gaming system to perform operations to:

detect a characteristic of at least a first game play element of the first game content; and map at least a second game play element of the second game content to the first game play element according to the characteristic.

21. The gaming system of claim 20, wherein the characteristic comprises one or more of a game state, game physics, and a game theme associated with the first wagering game application.

22. The gaming system of claim 20, wherein the characteristic comprises a property of a symbol associated with the first game play element, wherein the symbol is associated with a pay table for the first wagering game application.

23. The gaming system of claim 20, wherein the one or more memory storage devices are configured to store instructions, which when executed by at least one of the one or more electronic processing devices cause the gaming system to perform operations to set a value associated with the second game outcome based on the characteristic.

* * * * *